US012534849B2

(12) United States Patent
Ko et al.

(10) Patent No.: US 12,534,849 B2
(45) Date of Patent: Jan. 27, 2026

(54) CLOTHING CARE APPARATUS

(71) Applicant: SAMSUNG ELECTRONICS CO., LTD., Suwon-si (KR)

(72) Inventors: Gihoon Ko, Suwon-si (KR); Jinsook Park, Suwon-si (KR); Myunggyu Kim, Suwon-si (KR); Youngsun Shin, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 18/743,439

(22) Filed: Jun. 14, 2024

(65) Prior Publication Data

US 2024/0328070 A1 Oct. 3, 2024

Related U.S. Application Data

(63) Continuation of application No. PCT/KR2023/000135, filed on Jan. 4, 2023.

(30) Foreign Application Priority Data

Feb. 17, 2022 (KR) ..... 10-2022-0021026

(51) Int. Cl.
*D06F 73/02* (2006.01)
*A47F 7/26* (2006.01)
(Continued)

(52) U.S. Cl.
CPC ..... *D06F 73/02* (2013.01); *A47F 7/26* (2013.01); *A47G 25/746* (2013.01); *D06F 58/10* (2013.01); *D06F 58/203* (2013.01)

(58) Field of Classification Search
CPC ..... D06F 73/02; D06F 58/10; D06F 57/203; A47B 61/02; A47B 61/06; A47F 7/24;
(Continued)

(56) References Cited

U.S. PATENT DOCUMENTS 283,728 A * 8/1883 Ward ..... A47G 25/0685 211/100
426,313 A * 4/1890 Paxson ..... A47G 25/0685 211/99

(Continued)

FOREIGN PATENT DOCUMENTS

EP 2 188 434 B1 1/2016
JP 7-255586 10/1995

(Continued)

OTHER PUBLICATIONS

International Search Report dated May 3, 2023 issued in PCT/KR2023/000135.
Written Opinion dated May 3, 2023 issued in PCT/KR2023/000135.

*Primary Examiner* — Jennifer E. Novosad

(74) *Attorney, Agent, or Firm* — STAAS & HALSEY LLP

(57) ABSTRACT

A clothes care apparatus includes a main body including a care room to accommodate clothes, a support disposed on a side wall of the care room, and a shelf frame to be detachably supported on the support and including a first side frame and a second side frame to be supported on the support and a plurality of support frames arranged between the first side frame and the second side frame to support items. The shelf frame is supported by the support, and is supported within the care room in response to coupling the shelf frame to one side wall of the care room so that the plurality of support frames is arranged to be spaced apart in an up-down direction.

11 Claims, 36 Drawing Sheets

(51) Int. Cl.
*A47G 25/74* (2006.01)
*D06F 58/10* (2006.01)
*D06F 58/20* (2006.01)

(58) Field of Classification Search
CPC ..... A47F 7/26; A47G 25/74; A47G 25/743; A47G 25/746; A47G 25/0685; A47G 25/4015
USPC ..... 211/85.3, 2, 90.02, 96, 104
See application file for complete search history.

(56) References Cited

U.S. PATENT DOCUMENTS 499,326 A * 6/1893 Masse ..... A47G 25/746 211/1
769,634 A * 9/1904 Pynchon ..... A47G 25/746 211/87.01
971,493 A * 9/1910 Crane ..... A47G 25/0685 211/99
978,423 A * 12/1910 Zizinia ..... A47G 25/0685 211/99
1,095,073 A * 4/1914 Bish ..... A47G 25/746 312/334.26
1,654,341 A * 12/1927 Mendiolagoitia .... A47G 25/746 211/90.01
1,748,469 A * 2/1930 Desmarais ..... A47G 25/746 211/85.3
1,767,545 A * 6/1930 Mossbacher ..... A47G 25/746 211/32
2,118,611 A * 5/1938 Kohler ..... A47G 25/746 211/99
2,545,996 A * 3/1951 Graham ..... A47G 25/746 211/104
2,561,728 A * 7/1951 Dolan ..... A47G 25/0685 211/171
2,615,579 A * 10/1952 Sampson ..... A47G 25/746 211/100
2,665,011 A * 1/1954 Simjian ..... A47G 25/746 211/99
2,675,130 A * 4/1954 Dore ..... A47G 25/18 211/118
2,699,873 A * 1/1955 Ballard ..... A47G 25/06 211/113
2,948,406 A * 8/1960 Steele ..... A47G 25/0685 211/99
3,178,033 A * 4/1965 Wirsing ..... A47K 10/14 D6/326
3,211,295 A * 10/1965 Weiss ..... A47G 25/0685 211/100
3,297,168 A * 1/1967 Fleming ..... A47G 25/746 211/89.01
3,794,182 A * 2/1974 Royeton ..... A47G 25/746 211/116
4,109,794 A * 8/1978 Samuel ..... A47G 25/746 211/100
4,611,721 A * 9/1986 Heckaman ..... A47G 25/746 248/240.4
5,020,759 A * 6/1991 Weber ..... A47F 7/005 248/309.2
5,160,048 A * 11/1992 Leyden ..... E05B 69/006 70/59
5,178,287 A * 1/1993 Klein ..... A47G 25/746 211/100
5,421,465 A * 6/1995 Dunner, Jr. ..... A47G 25/743 211/115
5,542,758 A * 8/1996 Brown ..... A47B 61/00 211/85.3
5,645,178 A * 7/1997 Conley, Jr. ..... A47G 25/746 248/490
6,152,312 A * 11/2000 Nava ..... A47G 25/06 211/94.01
6,390,308 B1 * 5/2002 Ebrahim ..... A47B 88/988 211/100
6,726,036 B2 * 4/2004 Koellner ..... D06F 57/12 211/172
7,748,802 B2 * 7/2010 Peruzzi ..... A47B 46/005 312/351
8,141,721 B2 * 3/2012 Harris-Bowman .... A45C 11/16 211/85.2
8,215,133 B2 7/2012 Kim et al.
9,506,185 B2 11/2016 Choi et al.
10,041,203 B2 8/2018 Ahn et al.
10,506,877 B1 * 12/2019 Edwards ..... A47B 61/04
10,779,668 B2 * 9/2020 Erickson ..... A47G 25/746
11,313,070 B2 * 4/2022 Chang ..... D06F 59/02
2009/0250417 A1 * 10/2009 McNiff ..... A47G 25/746 211/85.3
2012/0061340 A1 * 3/2012 Park ..... A47G 25/0657 211/175
2016/0178280 A1 * 6/2016 McAmis ..... D06F 57/12 211/123
2020/0080250 A1 * 3/2020 Chang ..... D06F 73/02
2023/0145586 A1 * 5/2023 Heo ..... D06F 73/02 34/661
2024/0328070 A1 * 10/2024 Ko ..... D06F 58/203

FOREIGN PATENT DOCUMENTS

JP 3215493 3/2018
KR 10-1435808 8/2014
KR 10-1737841 5/2017
KR 10-2020-0030408 3/2020
KR 10-2020-0096478 8/2020
KR 10-2021-0043229 4/2021
KR 10-2254903 5/2021
KR 10-2021-0117199 9/2021
KR 20230123798 A * 8/2023 ..... D06F 73/02
WO WO 2021/107411 A1 6/2021
WO WO-2023158097 A1 * 8/2023 ..... D06F 73/02

* cited by examiner

CLOTHING CARE APPARATUS

CROSS REFERENCE TO THE RELATED APPLICATION

This application is a continuation application, filed under 35 U.S.C. § 111 (a), of International Application PCT/KR2023/000135 filed Jan. 4, 2023, and is based on and claims priority under 35 U.S.C. § 119 to Korean Patent Applications No. 10-2022-0021026, filed on Feb. 17, 2022 in the Korean Intellectual Property Office, the disclosures of which are incorporated by reference herein in their entireties.

TECHNICAL FIELD

The present disclosure relates to a clothes care apparatus, and more specifically, to a clothes care apparatus including a shelf frame.

BACKGROUND ART

A clothes care apparatus is an apparatus device that performs clothes care, such as drying wet clothes, removing dust attached to clothes or odors from clothes, and reducing wrinkles in clothes.

A clothes care apparatus may be equipped with a clothes care room, which is an accommodating space for clothes, and a steam generating device to perform refreshing functions such as removing wrinkles, deodorizing, and removing static electricity from clothes and the like.

In general, a clothes care apparatus may remove fine dust and wrinkles from clothes by supplying steam to the clothes and transmitting a mechanical force through strong air currents or vibration. Alternatively, a clothes care apparatus may remove wrinkles by a method of holding clothes on a compressor provided therein and then applying a press to a part of the clothes.

A shelf frame may be disposed within a clothes care apparatus to support items, etc., and there is a growing demand for shelf frames capable of being arranged in various layouts.

DISCLOSURE

Technical Problem

The present disclosure is directed to providing a clothes care apparatus available in various layouts of a shelf frame disposed within a care room.

The present disclosure is directed to providing a clothes care apparatus including a structure capable of fixing clothes by arranging a shelf frame in an up-down direction.

Technical Solution

An aspect of the present disclosure provides a clothes care apparatus including a main body including a care room to accommodate clothes, a support disposed on a side wall of the care room, and a shelf frame to be detachably supported on the support and including a first side frame and a second side frame to be supported on the support and a plurality of support frames arranged between the first side frame and the second side frame to support items, wherein the shelf frame is supported within the care room in response to coupling the shelf frame to one side wall of the care room so that the plurality of support frames is arranged to be spaced apart in an up-down direction.

The shelf frame may further include a hook disposed on one of the first side frame and the second side frame so that the plurality of support frames is supported within the care room and is arranged to be spaced apart in the up-down direction.

The clothes care apparatus may further include a lock disposed on a side wall of the care room to be coupled with the hook.

The hook may be on the first side frame to be rotatable with respect to the first side frame.

The hook may be movable between a locked position in which the hook protrudes to outside of the shelf frame to be capable of being coupled with the lock and an accommodated position in which the hook is rotated from the locked position toward inside of the shelf frame, and the shelf frame may further include a hook accommodating groove to accommodate the hook.

The first side frame may further include a wire body and a hook housing connected to the wire body, and the hook and the hook accommodating groove may be in the hook housing.

The lock may be rotatably coupled to the support.

The clothes care apparatus may further include a support bar disposed on an upper side of the care room to extend between opposite side walls of the care room, wherein the shelf frame may further include a hook to be capable of being coupled to the support bar.

The hook may be disposed on the first side frame, and the second side frame may include a clamp provided to secure a position of clothes supported by the shelf frame.

The clamp may include a cover to be rotatable with respect to the second side frame and a coupling plate disposed on the second side frame to fix the clothes to the second side frame.

The shelf frame may further include an open portion to be adjacent to front ends of the plurality of support frames.

The shelf frame may further include an opening and closing frame to open or close the open portion.

The opening and closing frame may be movable between an opened position in which the opening and closing frame is coupled to the first side frame and the second side frame to open the open portion and a closed position in which the opening and closing frame closes the open portion.

The shelf frame may further include a first connection frame on a front side of the plurality of support frames and a second connection frame on a rear side of the plurality of support frames, the second connection frame may be rotatable relative to the first side frame and the second side frame, and one sides of the plurality of support frames may be connected to the second connection frame and other sides of the plurality of support frames may be detachably coupled to the first connection frame.

The shelf frame may further include a connection frame connecting the first side frame and the second side frame, the hook may be on the connection frame, and the plurality of support frames may be arranged in the up-down direction with respect to the connection frame in response to supporting the shelf frame by the lock in the care room.

Another aspect of the present disclosure provides a clothes care apparatus including a main body including a care room provided to accommodate clothes and including a frame support part provided in the care room, and a shelf frame provided to be capable of being disposed inside the care room and including a first side frame and a second side frame provided to be capable of being disposed adjacent to opposite side walls of the care room and at least one support frame arranged between the first side frame and the second side frame to support items, wherein the shelf frame further includes an open portion provided to be adjacent to the front end of the at least one support frame, and a hook provided to be capable of being supported on the frame support part in the care room so that the shelf frame is capable of being arranged in an up-down direction in the care room to accommodate clothes.

The frame support part may include a lock disposed on one side wall of the care room to be coupled with the hook, the hook may be movable between a locked position in which the hook is positioned to be capable of being coupled with the lock and an accommodated position in which the hook is rotated from the locked position toward the inside of the shelf frame, and the shelf frame may further include a hook accommodating groove provided to accommodate the hook.

The frame support part may include a support bar disposed on an upper side of the care room and extending between the opposite side walls of the care room, and the hook may be capable of being coupled to the support bar.

The shelf frame may further include an opening and closing frame capable of opening and closing the open portion.

Another aspect of the present disclosure provides a clothes care apparatus including a main body including a care room provided to accommodate clothes, a shelf frame provided to be capable of being disposed inside the care room and including a first side frame and a second side frame extending in an front-rear direction, a connection frame connecting the first side frame and the second side frame, and at least one support frame extending in a first direction and arranged in a second direction between the first side frame and the second side frame to support items, a support disposed on a side wall of the care room to support the first side frame and the second side frame, a lock provided to enable the shelf frame to be arranged in an up-down direction within the care room, and a support bar disposed on an upper side of the care room to accommodate the clothes in the care room and extending between opposite side walls of the care room, wherein the shelf frame further includes a hook coupled to the lock or the support bar to enable the shelf frame to be arranged in the up-down direction within the care room.

Advantageous Effects

According to one aspect, a shelf frame can be arranged in various ways within the care room, thereby increasing convenience.

According to another aspect, because a plurality of clothes can be supported by the shelf frame, a space of the care room can be used more efficiently.

MODE OF THE DISCLOSURE

Figure 1:
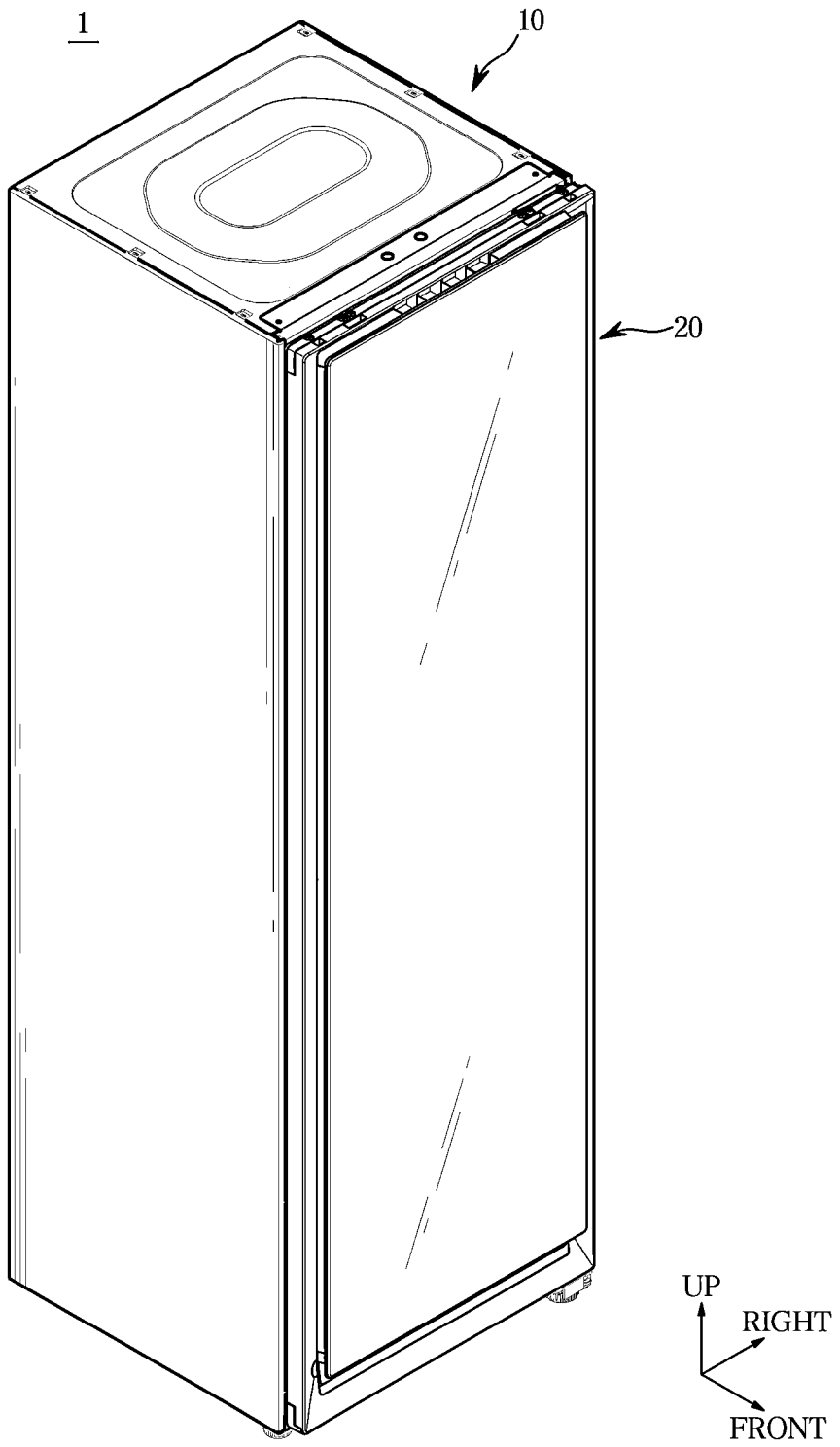
FIG. 1 is a perspective view of a clothes care apparatus according to one example.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, components, parts, or combinations thereof described in the specification, and do not exclude the presence or addition of one or more other features, numbers, steps, operations, components, parts, or combinations thereof.

It will be understood that, although the terms "first," "second," etc., may be used herein to describe various components, these components should not be limited by these terms, and the above terms are only used to distinguish one component from another. For example, without departing from the scope of the present disclosure, a first component may be referred to as a second component, and similarly, the second component may also be referred to as a first component. The term "and/or" includes any combination of a plurality of related items or any one of a plurality of related items. The expression "at least one of A, B and C" may include any of the following: A, B, C, A and B, A and C, B and C, A and B and C.

In this specification, the terms "front," "rear," and the like used in the following description are defined with reference to the drawings, and the shape and position of each component are not limited by these terms.

Hereinafter, embodiments of the present disclosure will be described in detail with reference to the accompanying drawings.

Figure 2:
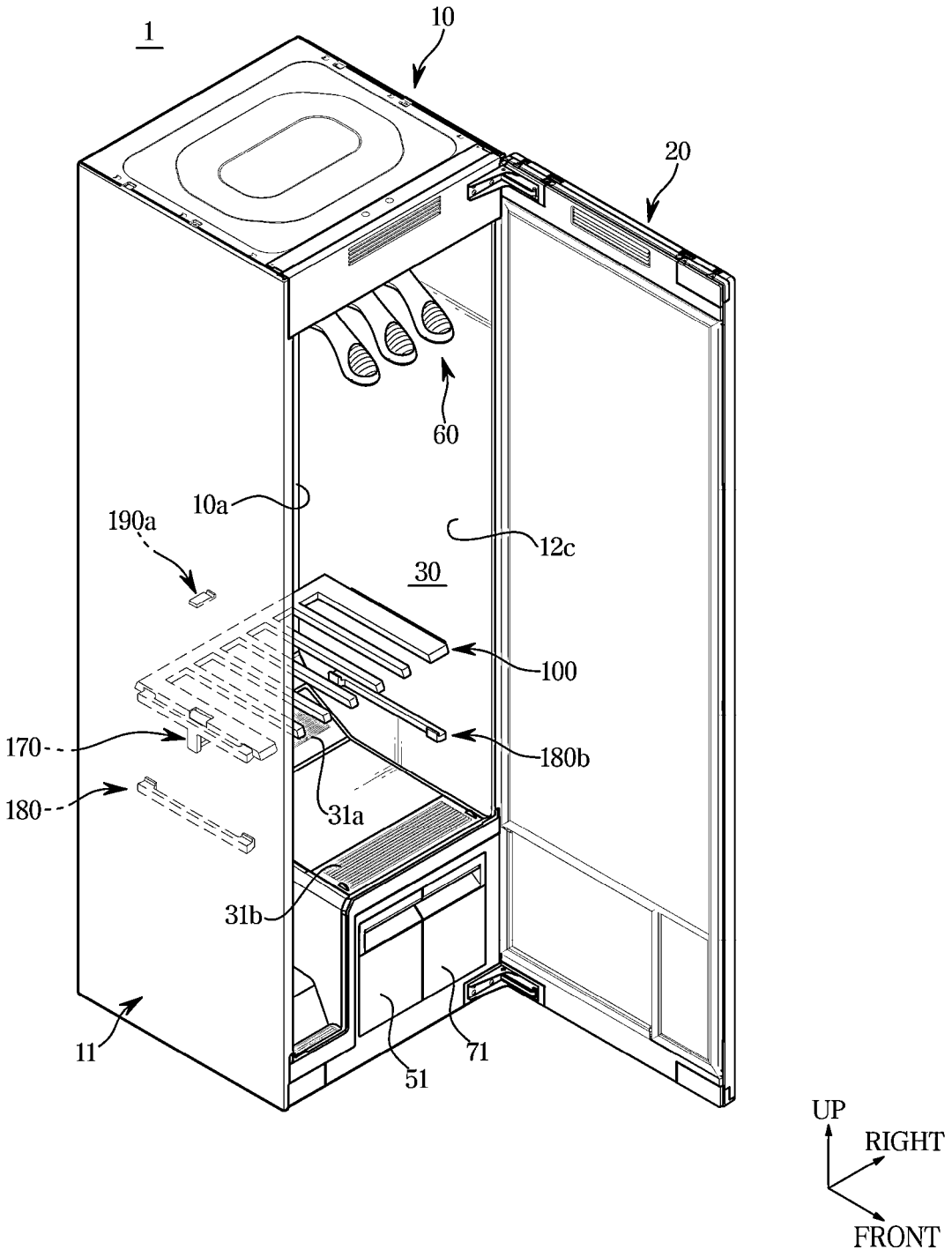
FIG. 2 is a perspective view of the clothes care apparatus in which a care room is opened according to one example.
Figure 3:
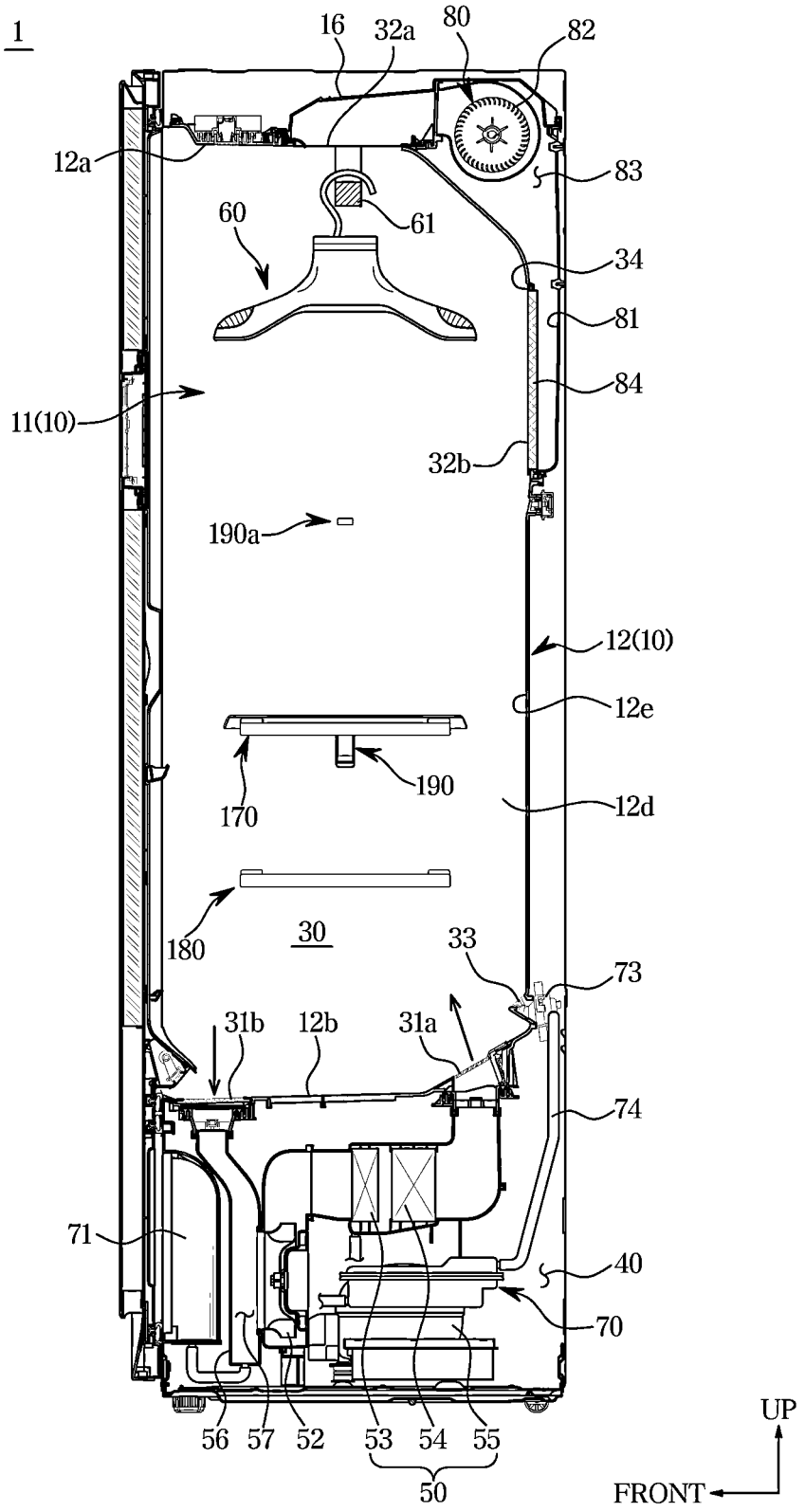
FIG. 3 is a side cross-sectional view of the clothes care apparatus according to one example.
Figure 4:
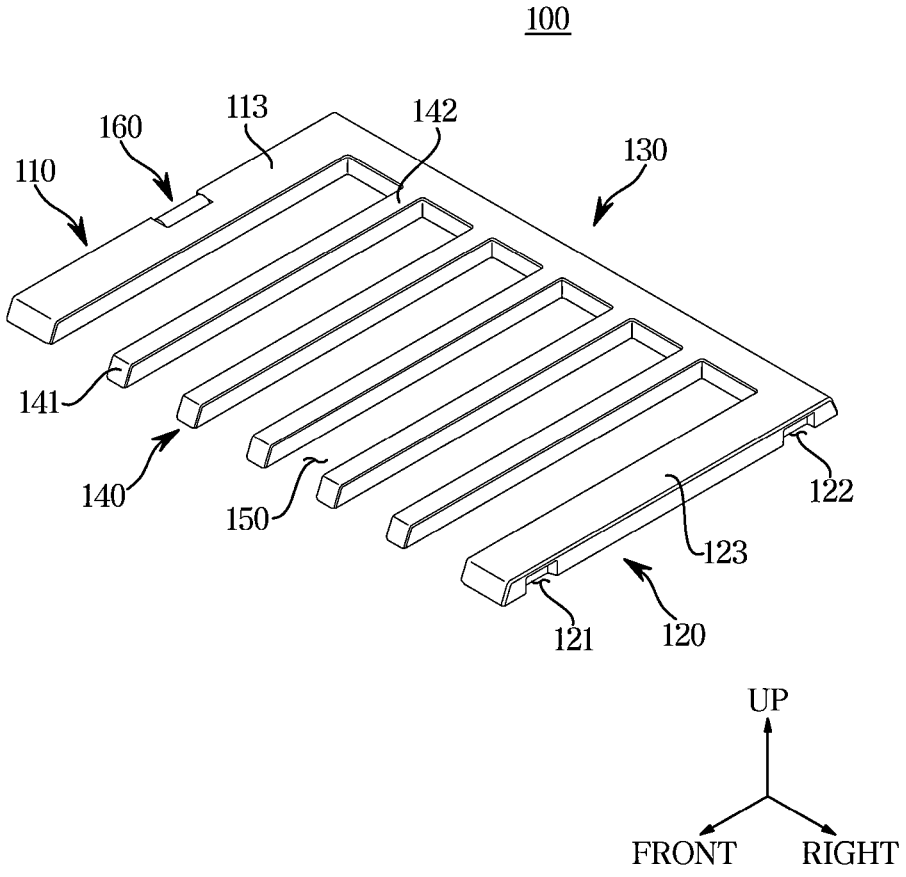
FIG. 4 is a perspective view of a shelf frame.
Figure 5:
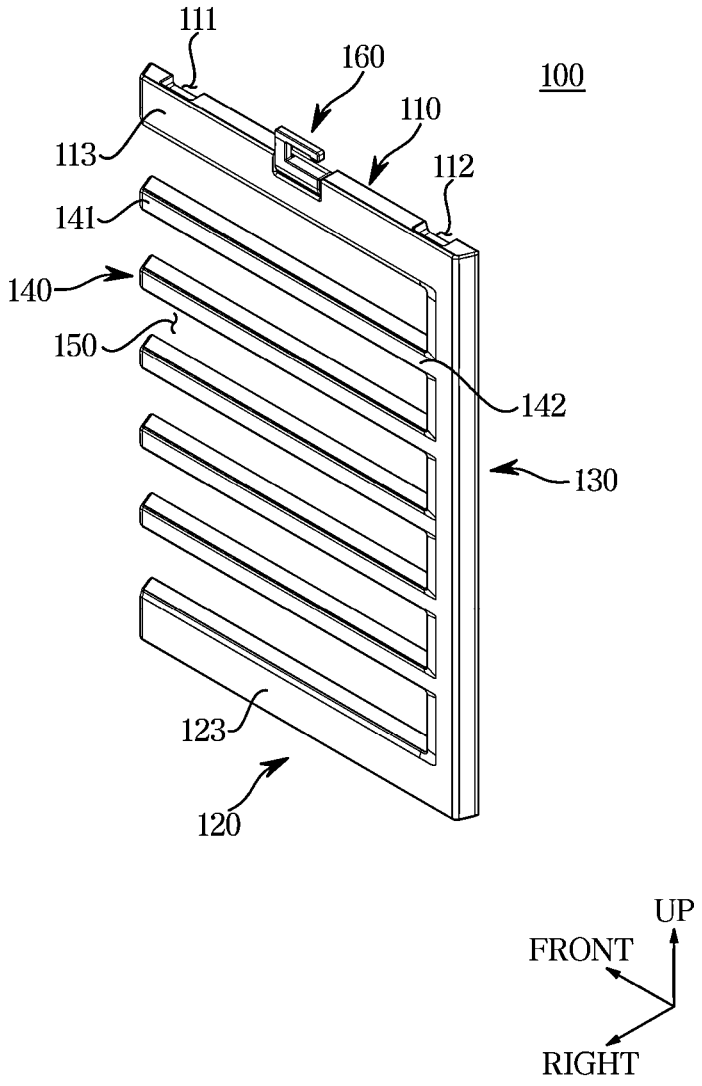
FIGS. 5 and 6 illustrate the shelf frame when a hook member is disposed in a locked position.
Figure 6:
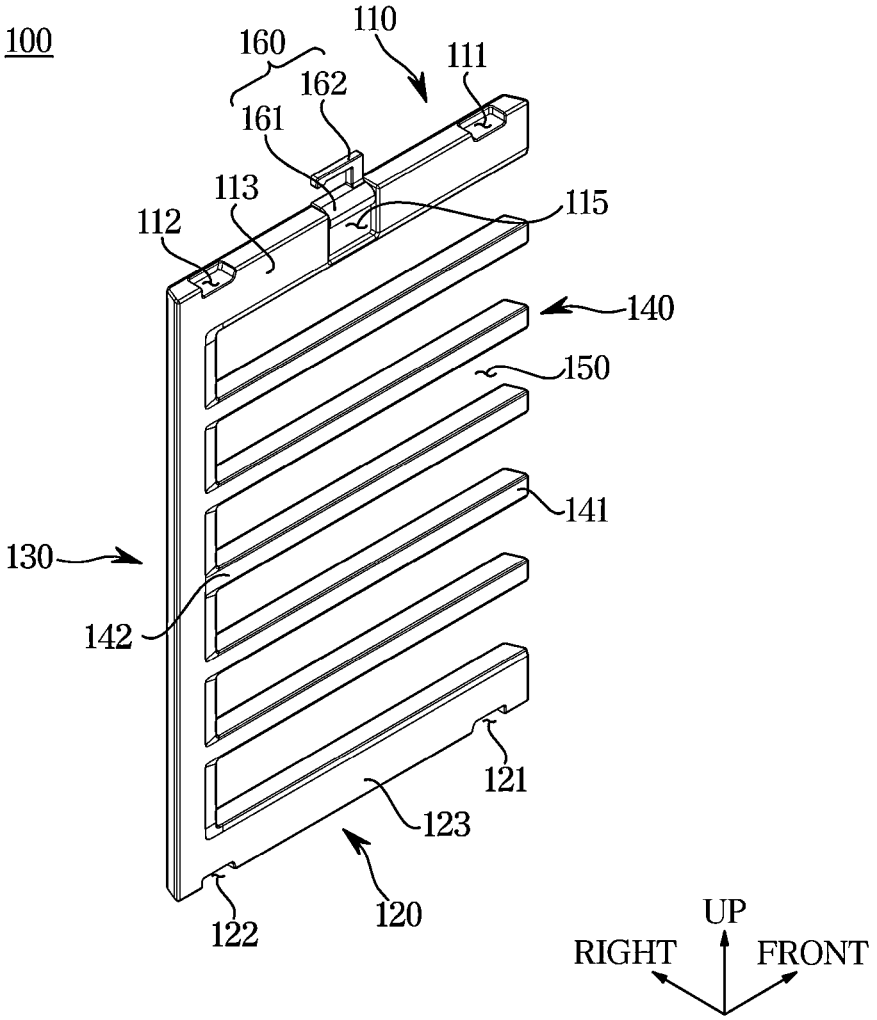
Figure 7:
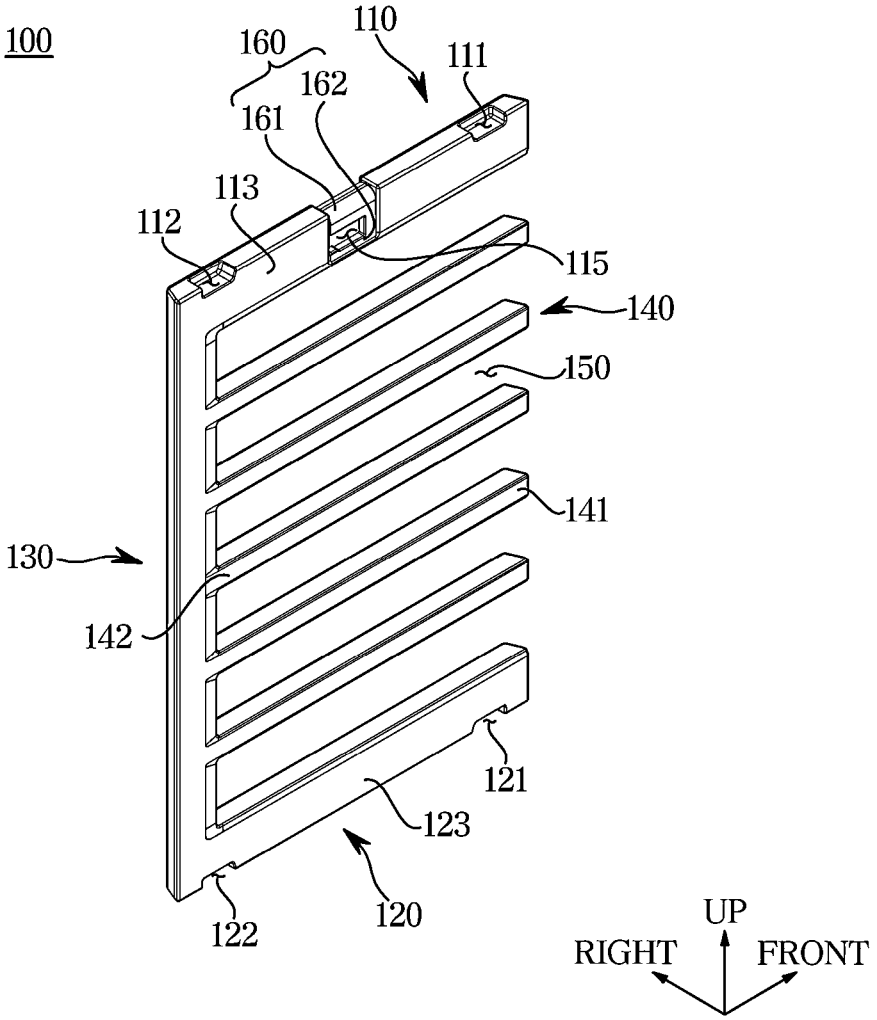
FIG. 7 illustrates the shelf frame when the hook member shown in FIG. is disposed in an accommodated position.

Referring to FIGS. 1 to 3, a clothes care apparatus 1 may include a main body 10 forming an exterior and a door 20 rotatably coupled to the main body 10.

The main body 10 may have a substantially hexahedral shape with one side open. An opening 10*a* may be formed on a front side of the main body 10. The door 20 rotatably installed on the main body 10 may open and close the care room 30.

Although not shown in the drawings, the door 20 may be installed on the main body 10 through hinges or links.

The main body 10 may include the care room 30 provided inside the main body 10 to accommodate and care for clothes. The opening 10*a* may be formed on a front side of the care room 30. The care room 30 may also be opened and closed by the door 20 opening and closing the opening 10*a*.

As illustrated in FIGS. 2 and 3, the main body 10 may include an outer cabinet and an inner cabinet 12 disposed inside the outer cabinet. The main body 10 may include a support bar 61 provided inside the care room 30 to hold a hanging member 60.

The main body 10 may include a machine room 40 equipped with a heat exchange device 50 provided to dehumidify or heat air inside the care room 30, etc.

The care room 30 may form a space in which clothes 2 are accommodated. The care room 30 may be configured to include an upper surface 12*a*, a lower surface 12*b*, a right surface 12*c*, a left surface 12*d*, and a rear surface 12*e*, which are provided in the inner cabinet 12.

The inner cabinet 12 may include a frame (not shown) provided to support the upper surface 12*a*, the lower surface 12*b*, the right surface 12*c*, the left surface 12*d*, and the rear surface 12*e*. A side wall 11 may form the left or right side of the care room 30. The side wall 11 may include the right surface 12*c* or the left surface 12*d* of the inner cabinet 12.

The frame (not shown) may form the care room 30 and the machine room 40 disposed below the care room 30. However, the present disclosure is not limited thereto.

The support bar 61 may be installed on the upper surface 12*a* of the care room 30. The support bar 61 may hold the hanging member 60 on which clothes are hung and a shelf frame 100.

The hanging member 60 may be installed to be separable from the support bar 61. One or more of the hanging members 60 may be provided. The hanging member 60 may be formed in the shape of a clothes hanger so that clothes may be fitted therein. However, the present disclosure is not limited thereto.

The care room 30 may include a first outlet 31*a* and a second outlet 32*a*, a first inlet 31*b* and a second inlet 32*b*, and a steam outlet 33.

The first outlet 31*a* and the first inlet 31*b* may be formed on the lower surface 12*b* of the care room 30. The first outlet 31*a* may be disposed on a rear side of the lower surface 12*b* of the care room 30. The first inlet 31*b* may be disposed on a front side of the lower surface 12*b* of the care room 30. The first outlet 31*a* and the first inlet 31*b* may be disposed to be adjacent to each other.

The steam outlet 33 may be disposed at a lower portion of the rear surface 12*e* of the care room 30. The steam outlet 33 may be disposed above the first outlet 31*a*.

The second outlet 32*a* may be formed at an upper portion of the upper surface 12*a* of the care room 30. The second inlet 32*b* may be formed at a center of the rear surface 12*e* of the care room 30. The second outlet 32*a* and the second inlet 32*b* may be disposed to be adjacent to each other.

The second outlet 32*a* of the care room 30 may be formed toward the hanging member 60. The air discharged through the second outlet 32*a* may be delivered to clothes hung on the hanging member 60.

A drain tank 51 and a water tank 71 provided to be detachable from the main body 10 may be installed in a lower portion of the main body 10. The drain tank 51 and the water tank 71 may be disposed at a lower portion of the care room 30.

The drain tank 51 may be provided to easily dispose of condensed water generated in the heat exchange device 50. Water needed to generate steam from a first steam generator 70 may be stored in the water tank 71.

The water in the water tank 71 may be supplied to the first steam generator 70 and used to generate steam. The water tank 71 may be installed to be detachable from the main body 10 to facilitate water replenishment.

The drain tank 51 and the water tank 71 may be provided on a front side of the machine room 40. The machine room 40 may be provided on a lower side of the main body 10. The machine room 40 may be provided below the care room 30.

A plurality of hoses may be provided, and the plurality of hoses may be used in the heat exchange device 50 or the first steam generator 70, respectively.

The heat exchange device 50 may be provided to dehumidify and heat air inside the care room 30 as needed.

The heat exchange device 50 may be installed to supply hot air to the inside of the care room 30. The heat exchange device 50 may include an evaporator 53, a condenser 54, and a compressor 55 through which a refrigerant circulates, and may be provided to dehumidify and heat air.

As the refrigerant evaporates in the evaporator 53 of the heat exchange device 50, latent heat of the surrounding air is absorbed, thereby condensing and removing moisture in the air.

When the refrigerant is condensed in the condenser 54 through the compressor 55, the latent heat is released toward the surrounding air, thereby heating the surrounding air.

As the evaporator 53 and the condenser 54 perform a heat exchange function, air introduced into the machine room 40 by a first fan 52 may be dehumidified and heated by sequentially passing through the evaporator 53 and the condenser 54.

The heat exchange device 50 installed in the machine room 40 may include a first duct 56 connecting the evaporator 53, the condenser 54, and the first fan 52, and the first duct 56 may be connected to the care room 30 to form a first flow path 57 between the care room 30 and the first duct 56.

The first duct 56 may be connected to the first outlet 31*a* and the first inlet 31*b* of the care room 30. One end of the first duct 56 may be connected to the first outlet 31*a*, and the other end thereof may be connected to the first inlet 31*b*.

Air in the care room 30 may be introduced into the first duct 56 through the first inlet 31*b*, and the introduced air may be dehumidified and discharged back to the care room 30 through the first outlet 31*a*.

The first outlet 31*a* may be disposed on a rear side of the care room 30, and the first inlet 31*b* may be disposed on the front side of the care room 30. However, the present disclosure is not limited thereto, and the positions of the first outlet 31*a* and the first inlet 31*b* may be variously changed as needed.

The first duct 56 may be provided so that air introduced through the first inlet 31*b* is dehumidified and the dehumidified air is discharged through the first outlet 31*a*. The first fan 52 may be provided in the first duct 56 to introduce air in the care room 30 into the first duct 56.

The first steam generator 70 provided to receive water from the water tank 71 and generate steam may be provided in the machine room 40.

The first steam generator 70 may include a steam supply pipe 74 connected to the water tank 71 to receive water in the water tank and generate steam and to guide the generated steam to a steam injector 73. The steam injector 73 may be disposed at the lower portion of the rear surface 12*e* of the care room 30.

The steam injector 73 may have an end formed in a nozzle shape to smoothly inject steam into an inner space of the care room 30, and may be installed to be exposed to the inside of the care room 30.

The care room 30 may include a blower 80 provided to flow air inside the care room 30. The blower 80 may include a second duct 81, and a second fan 82 may be installed inside the second duct 81.

The second duct 81 may be provided to communicate with the care room 30 to form a second flow path 83 between the care room 30 and the second duct 81. The second fan 82 may be disposed in the second flow path 83.

The second duct 81 may be formed on a rear side of the second inlet 32*b* of the care room 30. The second duct 81 may be provided on an upper side of the rear surface 12*e* of the care room 30 and may include a filter 84 therein.

The filter 84 may include the high efficiency particulate air (HEPA) filter 84. However, the present disclosure is not limited thereto.

The second duct 81 may be coupled to a top cover 16 disposed at an upper portion of the care room 30. The blower 80 is disposed on an upper rear side of the care room 30 and may include a motor (not shown) to generate a rotational force and the at least one second fan 82 to be rotated by the motor.

The at least one second fan 82 may be provided as a pair. The pair of second fans 82 may be provided as centrifugal fans that intakes air in an axial direction and discharges the air outward in a radial direction. However, the present disclosure is not limited thereto.

The second duct 81 may be connected to the second outlet 32*a* and the second inlet 32*b* of the care room 30. One end of the second duct 81 may be connected to the second outlet 32*a*, and the other end thereof may be connected to the second inlet 32*b* of the care room 30.

The second outlet 32*a* is disposed to be adjacent to the hanging member 60 so that air in the second duct 81 may be delivered to the hanging member 60.

The second fan 82 disposed inside the second duct 81 may be provided to introduce air in the care room 30 through the second inlet 32*b* and discharge the introduced air through the second outlet 32*a*.

A filter installation portion 34 for installing the filter 84 may be provided on the rear surface 12*e* of the care room 30. The second inlet 32*b* may be formed at a position corresponding to the filter installation portion 34.

The air in the care room 30 may be filtered by the filter 84 of the second inlet 32*b* when introduced into the second duct 81. Dust and odor contained in the air introduced into the second duct 81 may be removed by the filter 84.

The air filtered by the filter 84 may be discharged to the hanging member 60 through the blower 80. The filter 84 may include a dust collection filter (not shown) to remove dust or a means for deodorization.

When clothes are cared, the care room 30 may be operated in a state in which the clothes are hung on the hanging member 60 and the door 20 is closed. The air in the care room 30 may be circulated along the first flow path 57 and the second flow path 83.

The clothes care apparatus 1 may include support members or supports 170, 180, 180*a*, and 180*b* (see FIG. 9) which may be disposed on side walls of the care room 30, and locking members 190 and 190*a*. The support members 170, 180, 180*a*, and 180*b* may be installed on the right surface 12*c* or the left surface 12*d* as illustrated in the drawings. A plurality of the support members 170, 180, 180*a*, and 180*b* may be provided and installed to be spaced apart in an up-down direction.

The support members 170, 180, 180*a*, and 180*b* may include the first support member or the first support 170, the second support member or the second support 180, and the third support member or the third support 180*a* and 180*b*. The locking members 190 and 190*a* may include the first locking member or the first lock 190 and the second locking member of the second lock 190*a*. The first support member 170 may have a shape of being coupled with the first locking member 190, and the second support member 180 and third support members 180*a* and 180*b* may have a configuration of extending in a front-rear direction of the care room 30. The support members 170, 180, 180*a*, and 180*b* may all have a configuration for supporting the shelf frame 100. The second support member 180 and the third support member 180*a* and 180*b* may have a configuration of being symmetrical to each other.

The first support member 170, the second support member 180, or the third support members 180*a* and 180*b* may be provided inside the care room 30. According to one example, the first support member 170 and the second support member 180 may be provided on one side of the care room 30, and a pair of the third support members 180*a* and 180*b* may be provided on the other side of the care room 30. More specifically, the second support member 180 may be installed on the left surface 12*d* of the care room 30, and the third support members 180*a* and 180*b* may be installed on the right surface 12*c* of the care room 30.

The first support member 170 and the second support member 180 may be disposed to correspond to heights of the third support members 180*a* and 180*b*, respectively. More specifically, the third support members 180*a* and 180*b* may include the third upper support member 180*a* and the third lower support member 180*b*. The first support member 170 may be installed at a height corresponding to the third upper support member 180*a*, and the second support member 180 may be installed at a height corresponding to the third lower support member 180*b*.

However, the present disclosure is not limited thereto, the first support member 170, the second support member 180, or the third support members 180*a* and 180*b* may not be installed on the side wall 11 of the care room 30, and as long as the shelf frame 100 may be supported, it is sufficient for the support members to have any configuration.

The locking members 190 and 190*a* may be used in the form of the first locking member 190 capable of being coupled to the first support member 170 or the second locking member 190*a* capable of being coupled to the side wall 11 of the care room 30.

The clothes care apparatus 1 may include the shelf frame 100 provided to be capable of being disposed inside the care room 30. The shelf frame 100 may be disposed inside the care room 30 to be supported by the support members 170, 180, 180*a*, and 180*b*. When the shelf frame 100 is supported by the support members 170, 180, 180*a*, and 180*b*, a hat or other clothes may be placed on an upper side of the shelf frame 100.

The shelf frame 100 may be supported by one of the first support member 170 or the second support member 180 provided on one side and the third support member 180*a* and 180*b* provided on the other side.

The shelf frame 100 may be supported by the second support member 180 and the third lower support member 180*b* provided on opposite sides. Although not shown in the drawings, the shelf frame 100 may be supported by the first support members 170 provided on the opposite sides. The first support members 170 provided on the opposite sides may also be provided at corresponding heights to each other and have a configuration of being symmetrical to each other, and according to this structure, the first locking members 190 may be provided on the left surface 12*c* and the right surface 12*d* of the care room 30.

The shelf frame 100, the support members 170, 180, 180*a*, and 180*b*, and the locking members 190 and 190*a* according to one example will be described in detail below with reference to FIGS. 4 to 8.

The shelf frame 100 may include a first side frame 110, a second side frame 120, a connection frame 130, and at least one support frame 140. The at least one support frame 140 may be provided as a plurality of configurations to form a plurality of the support frames 140.

The first side frame 110 and the second side frame 120 may be disposed on opposite sides of the shelf frame 100, and may be supported by the support members 170, 180, 180*a*, and 180*b*. The connection frame 130 may have a configuration of connecting the first side frame 110 and the second side frame 120. The connection frame 130 may connect the rears of the first side frame 110 and the second side frame 120.

The at least one support frame 140 may extend in a first direction and be arranged in a second direction between the first side frame 110 and the second side frame 120 to support items. As illustrated in the drawings, the first direction may be a direction corresponding to an extending direction of the first side frame 110 and the second side frame 120, and the second direction may be a direction intersecting the first direction. However, the present disclosure is not limited thereto.

The first side frame 110 and the second side frame 120 may include support protrusion grooves 111, 112, 121, and 122 disposed to be spaced apart in the front-rear direction, respectively.

The support protrusion grooves 111, 112, 121, and 122 may include the front support protrusion grooves 111 and 121 formed on front sides of the first side frame 110 and the second side frame 120. The support protrusion grooves 111, 112, 121, and 122 may include the rear support protrusion grooves 112 and 122 formed on rear sides of the first side frame 110 and the second side frame 120.

The first side frame 110 may include a first side body 113. The second side frame 120 may include a second side body 123. The first side body 113 and the second side body 123 may extend from opposite sides of the connection frame 130 to the front side of the shelf frame 110. The first side body 113 and the second side body 123 may be disposed side by side with each other.

The at least one support frame 140 may be disposed such that one end 141 thereof faces forward, and may be connected to the connection frame 130 such that the other end 142 thereof is provided at a rear side thereof. The at least one support frame 140 may be provided as a plurality of configurations and disposed to be spaced apart from each other, and open portions 150 may be formed between the support frames 140 provided as a plurality of configurations. The one end 141 of the at least one support frame 140 may be the front end 141.

On the other hand, the one end 141 of the at least one support frame 140 may be disposed to face rearward, and the other end 142 may be provided at a front side. According to this structure, the open portion 150 may be provided on the rear side of the care room 30 (see FIG. 2).

The at least one support frame 140 may be provided as the single support frame 140. When the at least one support frame 140 is provided as the single support frame 140, the open portion 150 may be formed between the single support frame 140 and the first side frame 110 and the second side frame 120.

Likewise, the open portion 150 may be formed on a front side of the single support frame 140. That is, the open portion 150 may be provided to be adjacent to the one end 141 of the single support frame 140.

On the other hand, the position of the open portion 150 may be formed on the rear side of the single support frame 140. In this case, the one end 141 of the single support frame 140 may be provided to face the rear side of the care room 30.

The shelf frame 100 may include a hook member or a hook 160 capable of being provided on one of the first side frame 110, the second side frame 120, and the connection frame 130. The hook member 160 may be provided such that the at least one support frame 140 may be supported inside the care room 30 (see FIG. 2) in a state of being arranged in the up-down direction. In this case, the at least one support frame 140 may extend in the front-rear direction of the care room 30.

When the at least one support frame 140 is provided as a plurality of configurations, the shelf frame 100 may be supported within the care room 30 such that the plurality of support frames 140 is arranged to be spaced apart from each other in the up-down direction.

When the open portion 150 is formed on a front side of the shelf frame 100, the hook member 160 may be disposed to face the rear side of the first side frame 110. According to this structure, the shelf frame 100 may be inserted from the front to the rear of the care room 30. In this case, because the one end 141 of the at least one support frame 140 may face the opening 10*a* side of the clothes care apparatus 1 (see FIG. 2) when the hook member 160 is coupled to the frame support parts 61, 190, and 190*a*, clothes and the like may be easily received on the shelf frame 100.

As illustrated in the drawings, the hook member 160 may be provided on the first side frame 110 side. The hook member 160 may be rotatable with respect to the first side frame 110.

Unlike illustrated in the drawings, the hook member 160 may be formed integrally with the first side frame 110, the second side frame 120, or the connection frame 130. Additionally, the hook member 160 may have a structure capable of sliding so as to protrude from the first side frame 110, the second side frame 120, or the connection frame 130 toward the outside of the shelf frame 100.

The hook member 160 may be capable of being coupled with the locking members or locks 190 and 190*a*. The hook member 160 may be disposed in a locked position in which the hook member protrudes to the outside of the shelf frame 100 to be capable of being coupled with the locking members 190 and 190*a*. The hook member 160 may be disposed in an accommodated position in which the hook member is rotated toward the inside of the shelf frame 100 from the locked position. The hook member 160 may be rotatable with respect to the first side frame 110 to be movable between the locked position and the accommodated position.

A member such as silicon or rubber may be coupled to a coupled portion between the hook member 160 and the first side frame 110. This is to prevent the hook member 160 from rotating due to an own weight thereof when not coupled with the locking member 190 or 190*a*. The hook member 160 is not limited to this structure and may include a locking structure of being capable of fixing the hook member 160 in the locked position and the accommodated position.

The hook member 160 may include a rotational coupling part 161 provided to be coupled to the first side frame 110, and a hook protrusion 162 protruding from the rotational coupling part 161 to be coupled to the locking members 190 and 190*a*. The hook protrusion 162 may be coupled to the support bar 61.

The shelf frame 100 may include a hook accommodating groove 115 provided to accommodate the hook member 160. The hook accommodating groove 115 may be provided on a lower side of the shelf frame 100 on which the support protrusion grooves 111, 112, 121, and 122 are formed. The reason why the hook accommodating groove 115 is provided on the lower side is to improve the aesthetics of the shelf frame 100 when the shelf frame 100 is supported by the support members 170, 180, 180*a*, and 180*b*.

However, the hook accommodating groove 115 may be formed to be provided on the upper side of the shelf frame 100 when the shelf frame is supported by the support members 170, 180, 180*a*, and 1180*b*. According to this structure, the hook member 160 may be disposed in the accommodated position without a separate locking structure.

The present disclosure is not limited to the shelf frame 100 illustrated in FIGS. 4 to 7, and the hook member 160 may not be provided on the shelf frame 100. Unlike illustrated in FIG. 8, support protrusions 171 and 172 of the support members 170 and 180 may be provided as a single configuration. That is, the hook accommodating groove 115 of the shelf frame 100 may not be a groove for accommodating the hook member 160. In this case, the support protrusions 171 and 172 of the support members 170 and 180 may not be provided as a plurality of configurations but may be provided as at least one configuration, and in this case, at least one protrusion of the support members 170 and 180 may be inserted into the hook accommodating groove 115.

Instead of the configuration of the hook member 160, the shelf frame 100 may include a support member groove (not shown) capable of extending in a longitudinal direction of the first side frame 110 and the second side frame 120. According to this structure, the support members 170 and 180 may not include the configurations of the support protrusions 171, 172, 181, and 182, and the support members 170 and 180 may be inserted while sliding into the support member groove. The hook member 160 may also be detachably coupled to the shelf frame 100. According to this structure, the hook member 160 may be coupled to the shelf frame 100 only when the shelf frame 100 is disposed in the up-down direction.

Figure 8:
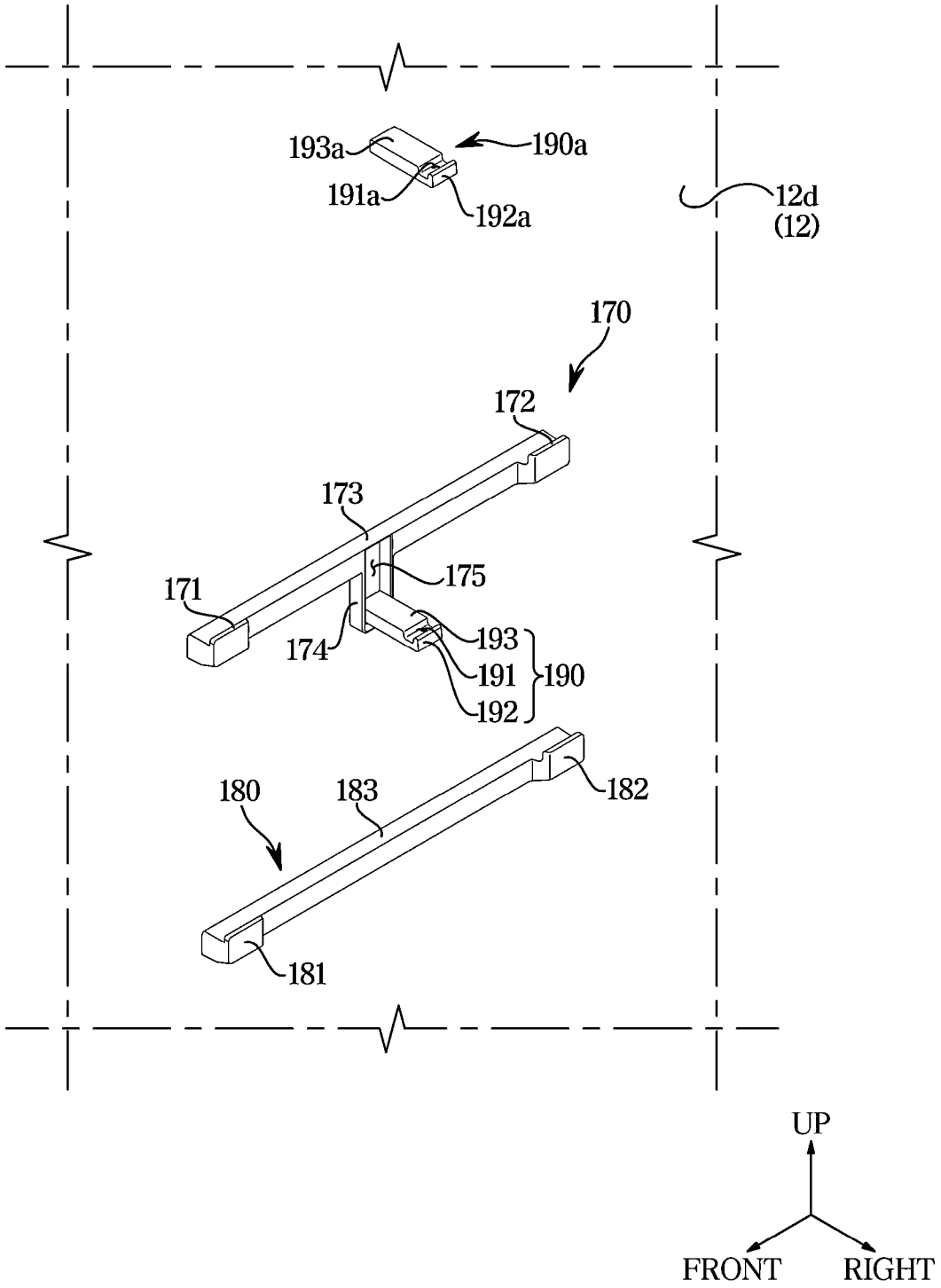
FIG. 8 illustrates that support members and locking members are installed on a left surface of the care room.

Structures of the support members 170, 180, 180*a*, and 180*b* and the locking members 190 and 190*a*, and a process in which the shelf frame 100 is coupled to the support members 170, 180, 180*a*, and 180*b* will be described in detail below with reference to FIGS. 8 and 9.

The support members 170, 180, 180*a*, and 180*b* and the locking members 190 and 190*a* may be disposed on the side wall 11 of the care room 30 (see FIG. 2). The support members 170, 180, 180*a*, and 180*b* and the locking members 190 and 190*a* may be disposed on the right surface 12*c* or the left surface 12*d* of the care room 30.

The frame support parts 61, 190, and 190*a* may include the locking members 190 and 190*a* and the support bar 61.

The support members 170, 180, 180*a*, and 180*b* may include the first support member 170 capable of being coupled with the locking members 190 and 190*a* and the second support member 180 capable of being used as a single configuration. The locking members 190 and 190*a* may include the first locking member 190 capable of being used by being coupled to the first support member 170 and the second locking member 190*a* capable of being used as a single configuration.

The first support member 170 and the second support member 180 may be disposed to be spaced apart in the up-down direction and may be provided on the left surface 12*d* of the care room 30. The pair of third support members 180*a* and 180*b* may be provided on the right surface 12*c* of the care room 30 to be spaced apart in the up-down direction.

The first support member 170 may be provided above the second support member 180. The first locking member 190 coupled to the first support member 170 may also be provided above the second support member 180. This configuration is intended to prevent clothes and the like that may be supported by the shelf frame 100 from coming into contact with a bottom of the care room 30 when the shelf frame 100 (see FIG. 6) is coupled to the first locking member 190.

The second locking member 190*a* may be provided above the first support member 170. Likewise, the second locking member 190*a* provided above the first support member 170 may hold the hook member 160 of the shelf frame 100. The second locking member 190*a* may be provided above the second support member 180.

The first support member 170 may include a support body 173 extending in the front-rear direction of the care room 30. The support protrusions 171 and 172 protruding upward may be disposed on front and rear sides of the support body 173, respectively. The support protrusions 171 and 172 may include the front support protrusion 171 disposed on a front side of the support body 173 and the rear support protrusion 172 disposed on the rear side of the support body 173.

The first support member 170 may include a locking member groove 175 provided to accommodate the first locking member 190 and a locking member coupling part 174 forming the locking member groove 175. The locking member coupling part 174 may have a shape of extending downward from the support body 173 between the support protrusions 171 and 172.

The locking member coupling part 174 may include the locking member groove 175. When the locking member 190 is not coupled with the hook member 160, the locking member 190 may be inserted into the locking member groove 175. The locking member 190 may be rotatably coupled to the locking member coupling part 174. The locking member 190 may be moved between a position in which the locking member protrudes to the inside of the care room 30 and a position in which the locking member is accommodated in the locking member groove 175.

According to this structure, when the locking member 190 is not coupled with the hook member 160, the locking member 190 may be moved into the locking member groove 175 to prevent interference with clothes and the like in the care room 30.

The first locking member 190 may be capable of being coupled with the hook member 160 when disposed in the position in which the first locking member protrudes to the inside of the care room 30. The locking members 190 and 190*a* may be formed such that the hook member 160 is seated therein. Hereinafter, a configuration of the first locking member 190 will be described, and a configuration of the second locking member 190*a* may correspond thereto.

More specifically, the first locking member 190 may include a body 193 coupled to the locking member coupling part 174. One side of the body 193 may be a part to be coupled to the locking member coupling part 174. The other side of the body 193 may be provided with a seating groove 191 and a locking protrusion 192 capable of fixing the hook member 160 so that the hook member 160 may be seated.

Unlike the configuration of the first support member 170, the second support member 180 may be used as a single configuration. The second support member 180 may include a support body 183 extending in the front-rear direction of the care room 30, a front protrusion 181 disposed on a front side of the support body 183, and a rear protrusion 182 disposed on a rear side of the support body 183.

The third support members 180*a* and 180*b* may include support bodies 183*a* and 183*b*, front protrusions 181*a* and 181*b*, and rear protrusions 182*a* and 182*b*, respectively, to correspond to the support body 183, the front protrusion 181, and the rear protrusion 182 of the second support member 180.

The front protrusion 171 of the first support member 170 may be inserted into the front protrusion groove 111 of the first side frame 110, and the rear protrusion 172 of the first support member 170 may be inserted into the rear protrusion groove 112 of the first side frame 110.

Likewise, the front protrusion 181*a* of the third upper support member 180*a* may be inserted into the front protrusion groove 121 (see FIG. 4) of the second side frame 120, and the rear protrusion 182*a* of the third upper support member 180*a* may be inserted into the rear protrusion groove 122 of the second side frame 120.

Also, the front protrusion 181 of the second support member 180 may be inserted into the front protrusion groove 111 of the first side frame 110, and the rear protrusion 182 of the second support member 180 may be inserted into the rear protrusion groove 112 of the first side frame 110.

The configuration of the third lower support member 180*b* may correspond to the configuration of the third upper support member 180*a*.

However, unlike illustrated in the drawings, the protrusions 171 and 172, 181 and 182, 181*a* and 182*a*, and 181*b* and 182*b* of the support members 170, 180, 180*a*, and 180*b* may be provided as single protrusions, and correspondingly, the shelf frame 100 may also have the protrusion grooves 111 and 112, and 121 and 122 provided as single grooves.

Due to this coupling, the open portion 150 of the shelf frame 100 may be formed on the front side of the care room 30, and the connection frame 130 of the shelf frame 100 may be formed on the rear side of the care room 30.

Figure 9:
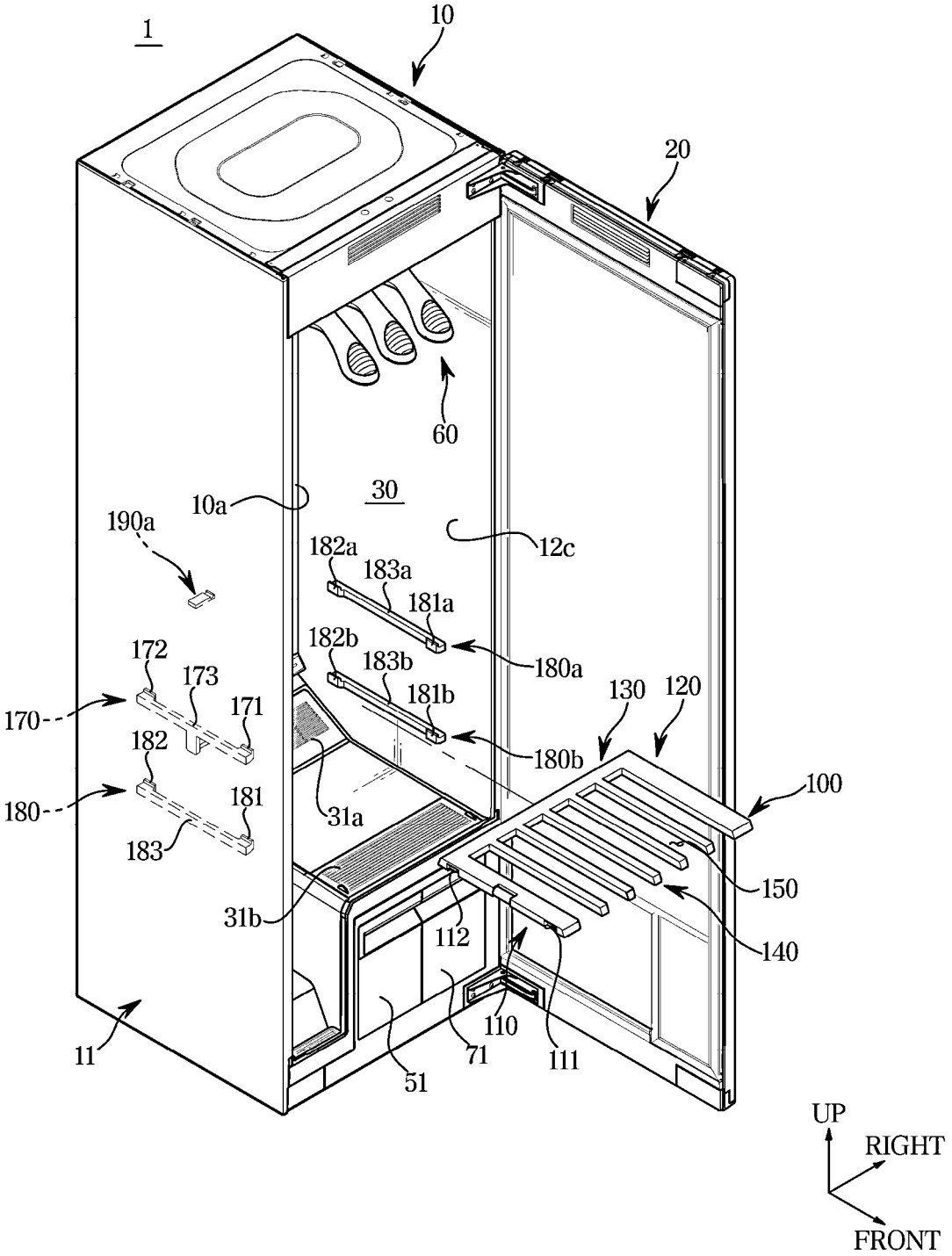
FIG. 9 illustrates that the shelf frame supported by support members is separated.

FIG. 9 illustrates the shelf frame 100 supported by the first support member 170 disposed on the left surface 12*d* (see FIG. 3) of the care room 30 and the third upper support member 180*a* disposed on the other side wall, but is not limited thereto. That is, the shelf frame 100 may be supported by the second support member 180 and the third lower support member 180*b* disposed on the side wall 11 of the care room 30.

Various arrangements of the shelf frame 100 in the care room 30 will be described in detail below with reference to FIGS. 9 to 12. As illustrated in FIG. 9, the shelf frame 100 may be supported by the support members 170, 180, 180*a*, and 180*b* inside the care room 30. According to this structure, the shelf frame 100 may be used to accommodate items on the upper side of the shelf frame 100.

Figure 10:
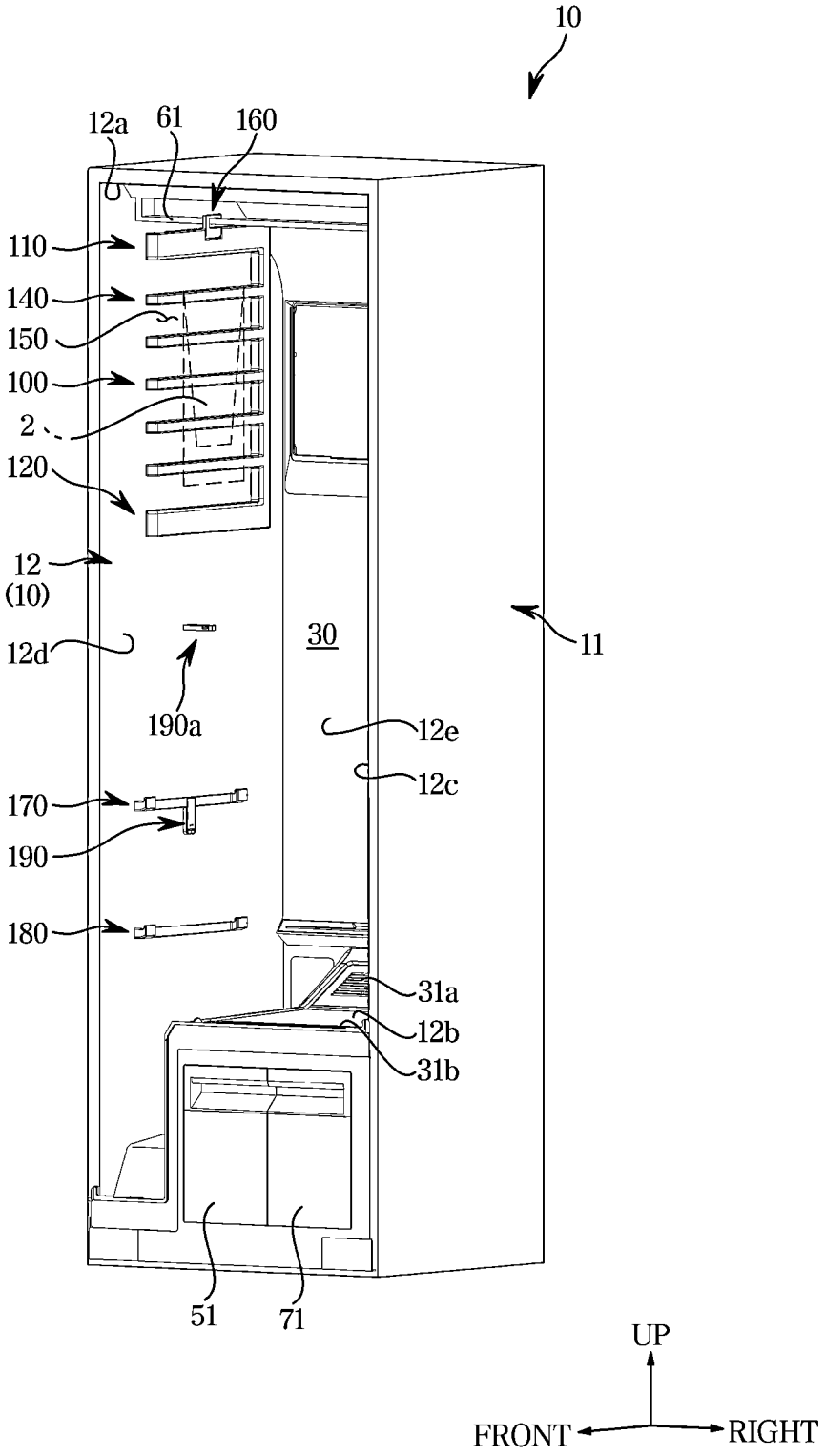
FIG. 10 illustrates the shelf frame when the hook member is supported by a support bar.

As illustrated in FIG. 10, the hook member 160 of the shelf frame 100 may be disposed to be coupled to the support bar 61. In this case, the shelf frame 100 may be arranged in the up-down direction within the care room 30. In this case, the at least one support frame 140 of the shelf frame 100 may extend in the front-rear direction of the care room 30.

More specifically, the shelf frame 100 may be supported by the support bar 61 such that the at least one support frame 140 is arranged in the up-down direction. According to this structure, by hanging the clothes 2 on the at least one support frame 140, the clothes 2 that are difficult to be supported on the hanging member 60 may also be hung in the up-down direction in the care room 30. In this case, what is supported by the at least one support frame 140 is not limited to the clothes 2, and may be a scarf or necktie.

Also, the open portion 150, which may be formed between the one or more support frames 140, may be formed on the front side of the care room 30. In this case, convenience may be increased when the clothes 2 are inserted from the front side of the one or more support frames 140 toward the rear side.

Figure 11:
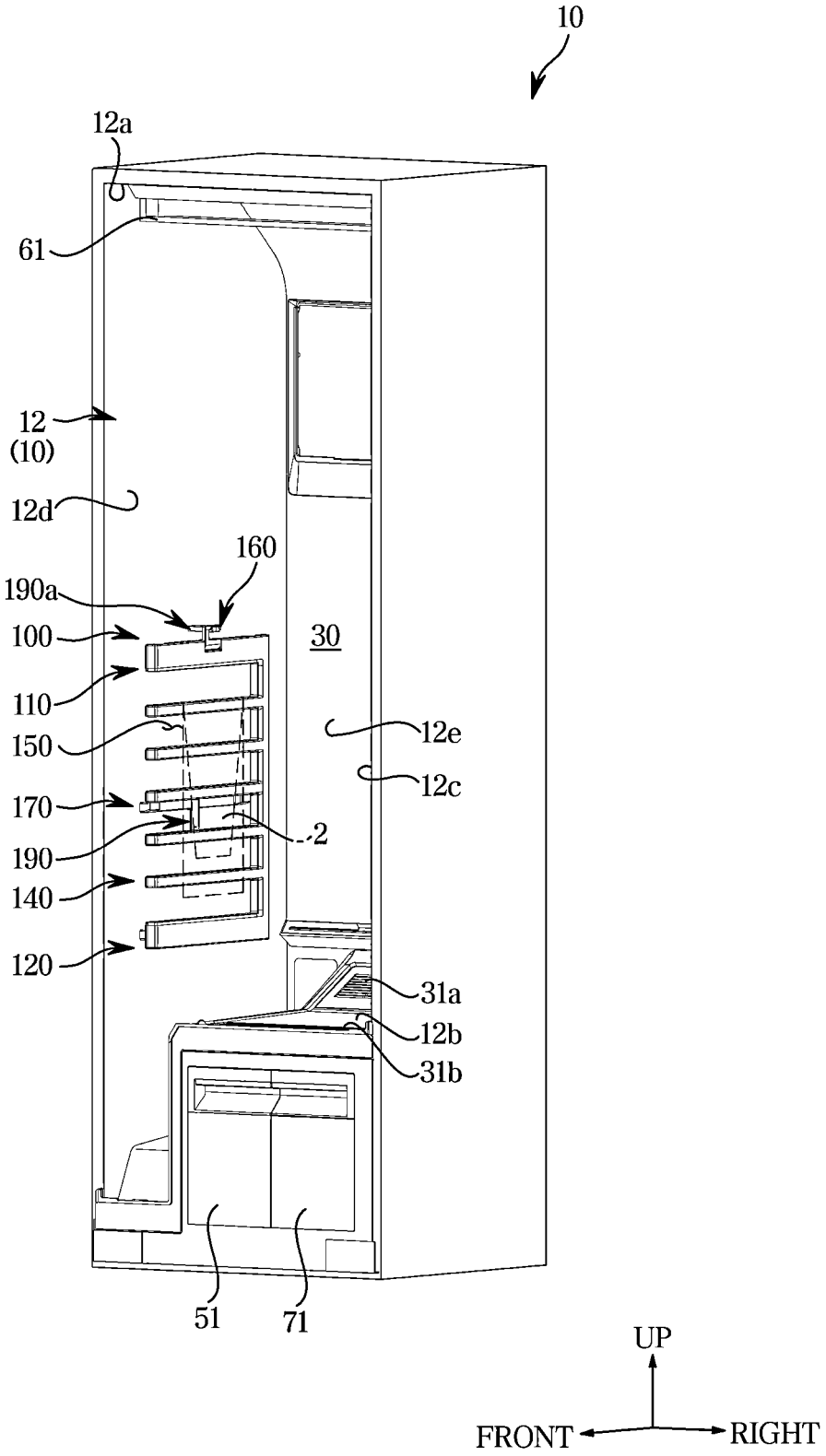
FIG. 11 illustrates the shelf frame when the hook member is supported by a second locking member.

As illustrated in FIG. 11, the hook member 160 of the shelf frame 100 may be disposed to be capable of being coupled to the second locking member 190*a*. As in FIG. 10, the shelf frame 100 may be arranged in the up-down direction within the care room 30.

That is, the at least one support frame 140 may be arranged in the up-down direction, and the open portion 150 may be disposed to be formed on the front side of the care room 30. According to this structure, even when the hanging members 60 of a sufficient number are held on the support bar 61, the extra clothes 2 or the like may be placed inside the care room 30 using the shelf frame 100.

Figure 12:
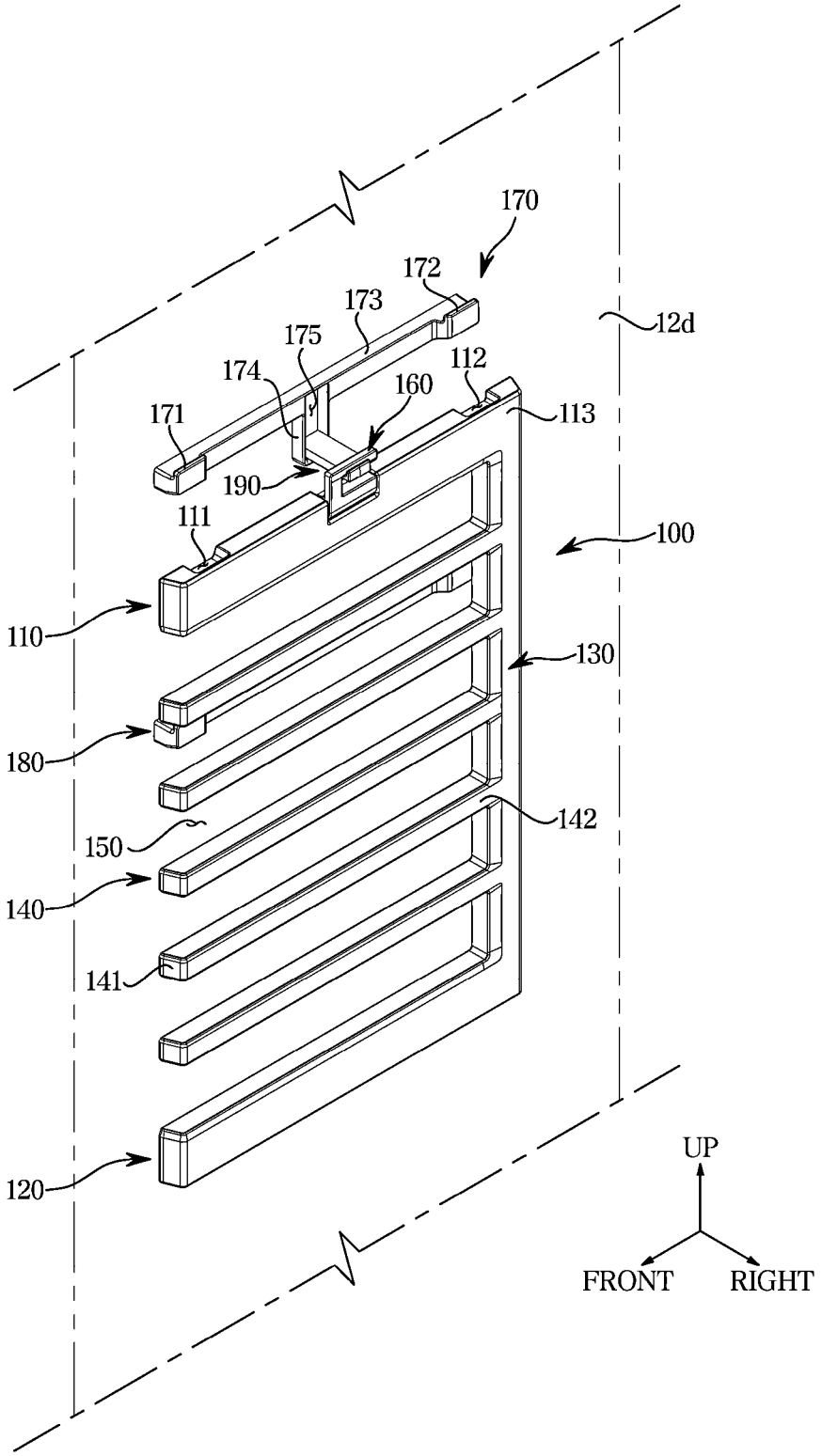
FIG. 12 is an enlarged view of the shelf frame according to one example when supported by a first locking member.
Figure 13:
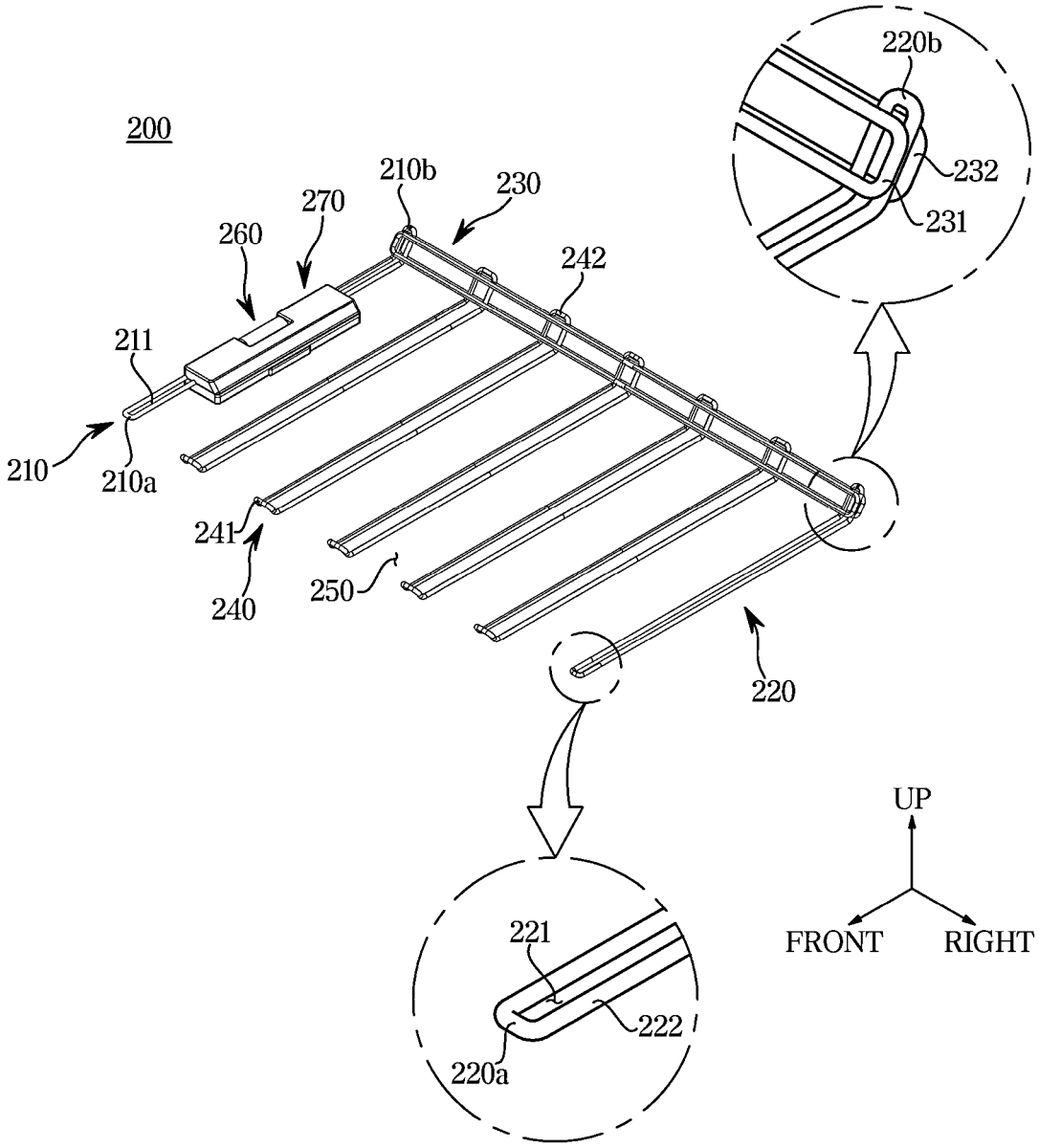
FIG. 13 is a perspective view of a shelf frame according to another example.
Figure 14:
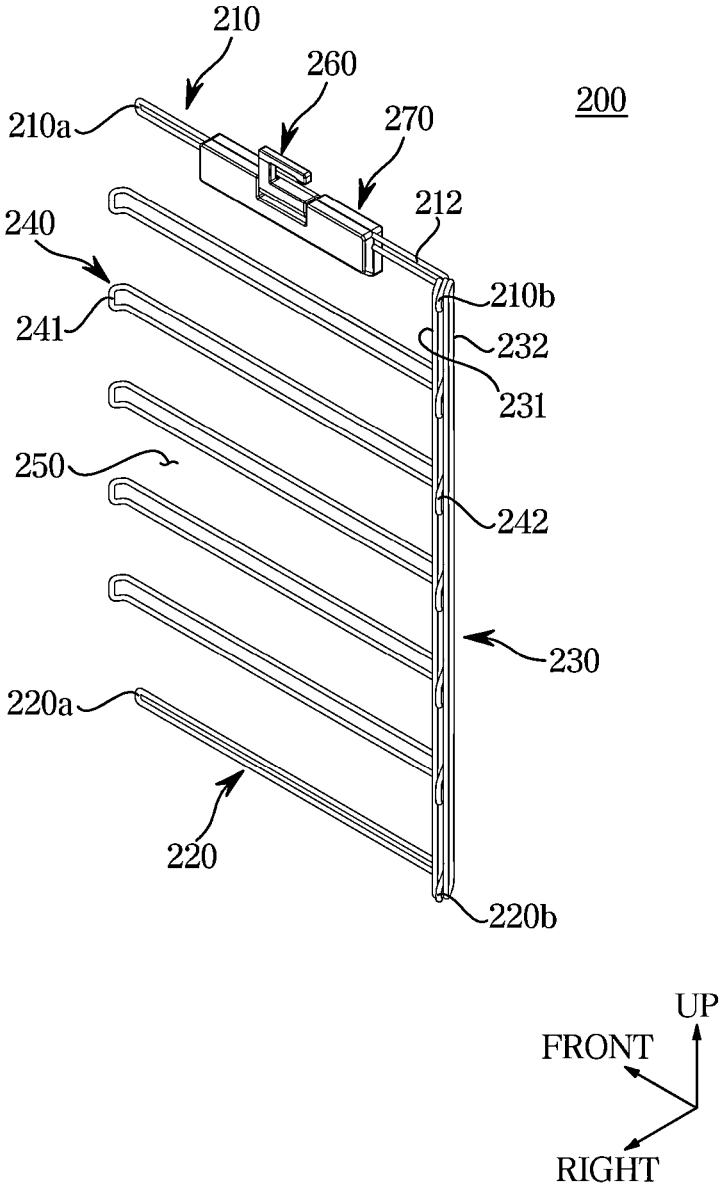
FIGS. 14 and 15 illustrate the shelf frame when a hook member is disposed in the locked position.
Figure 15:
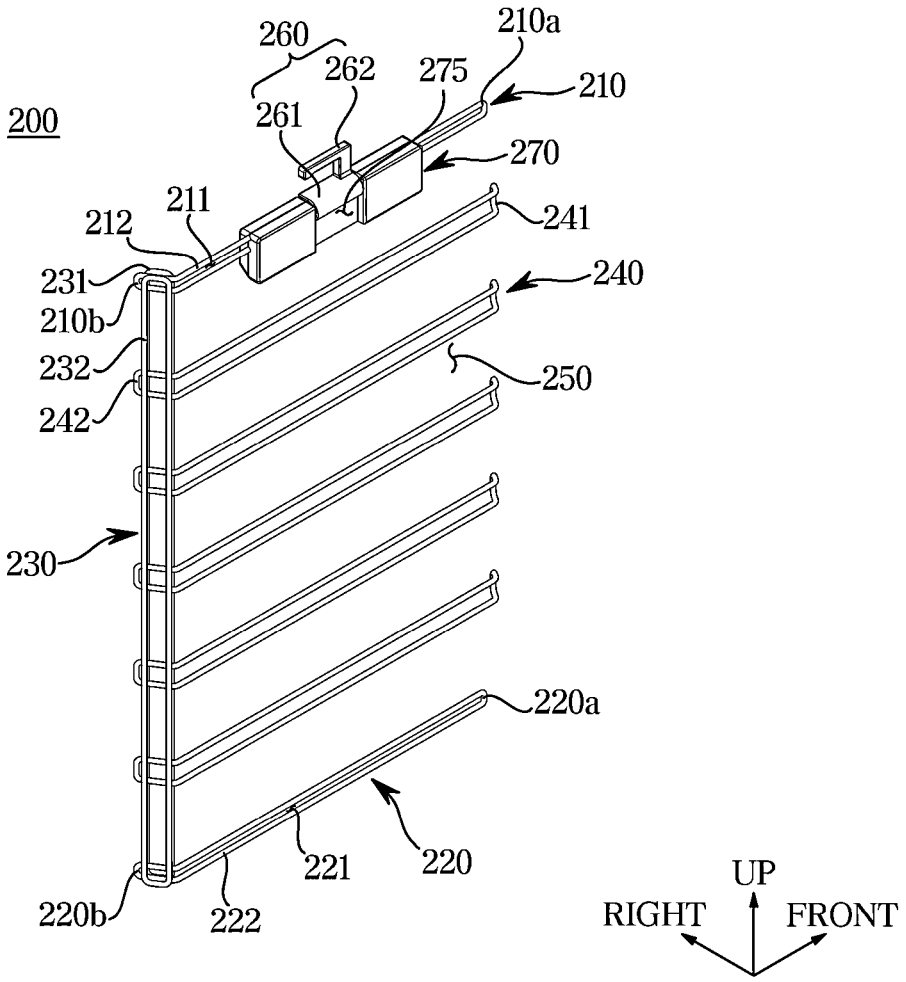
Figure 16:
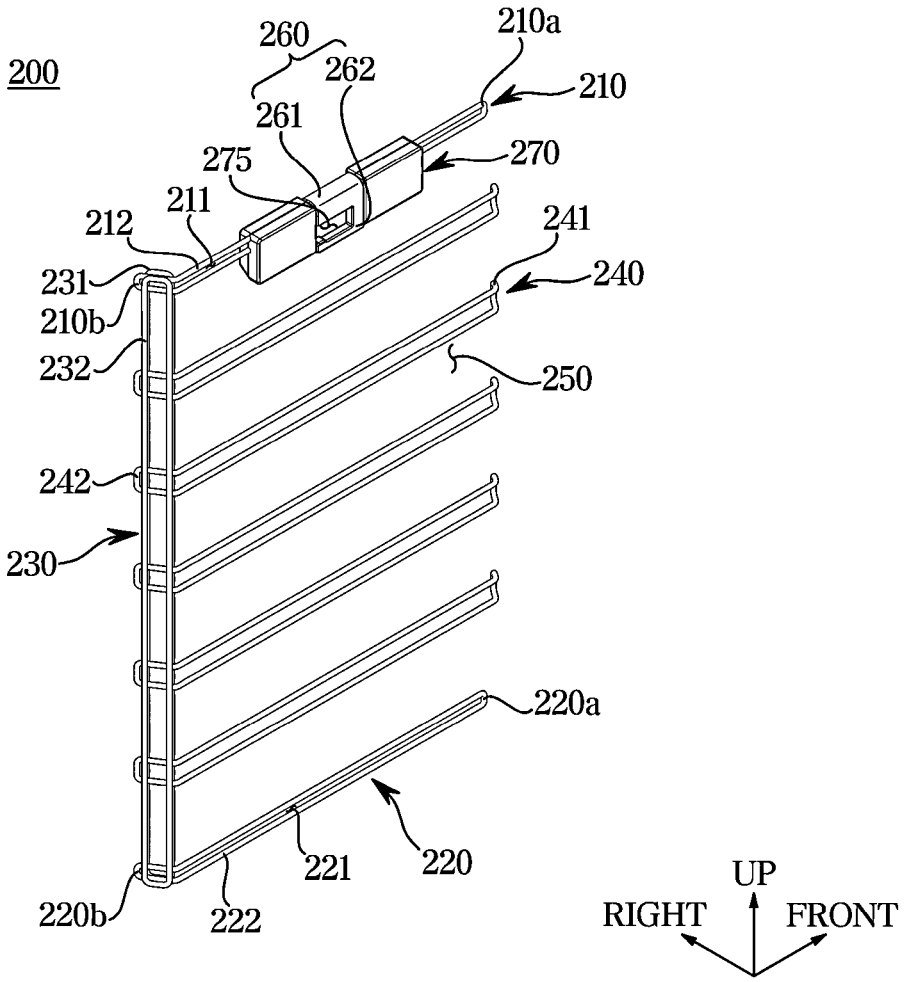
FIG. 16 illustrates the shelf frame when the hook member is placed in the accommodated position.
Figure 17:
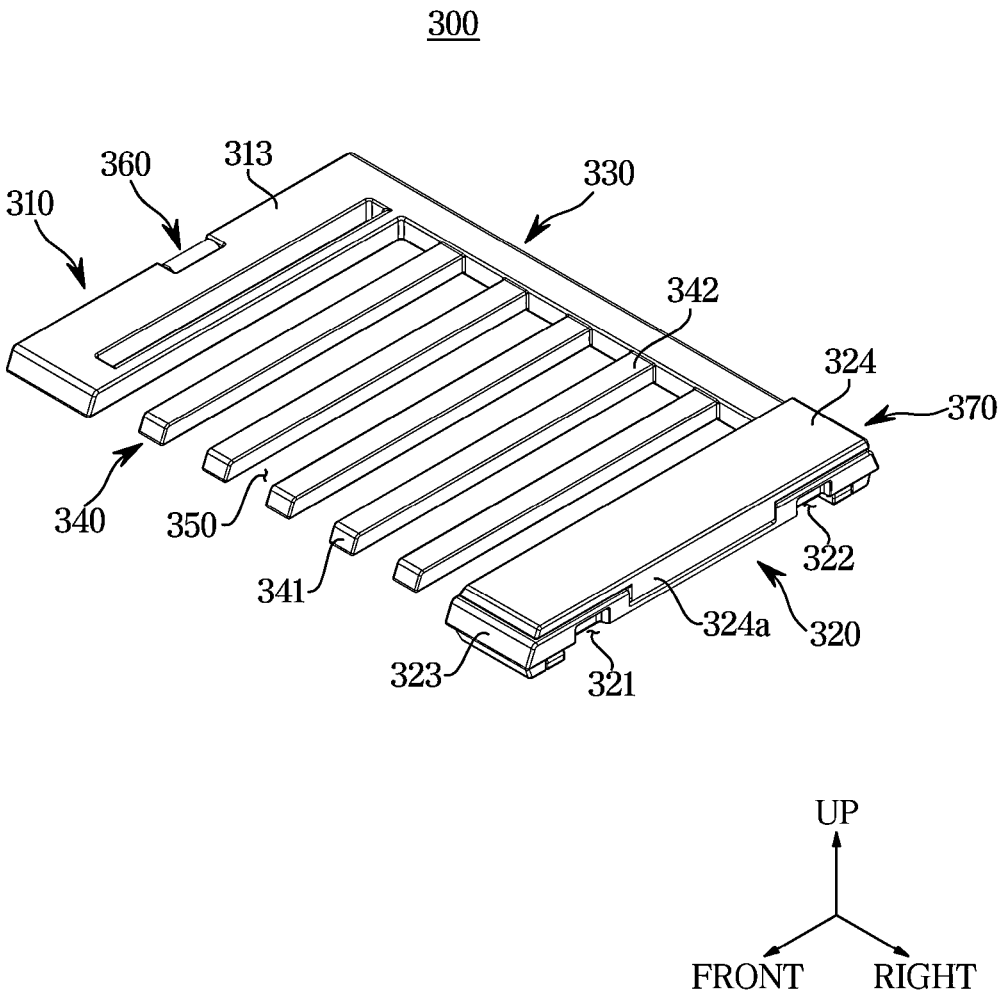
FIG. 17 illustrates a shelf frame according to another example.
Figure 18:
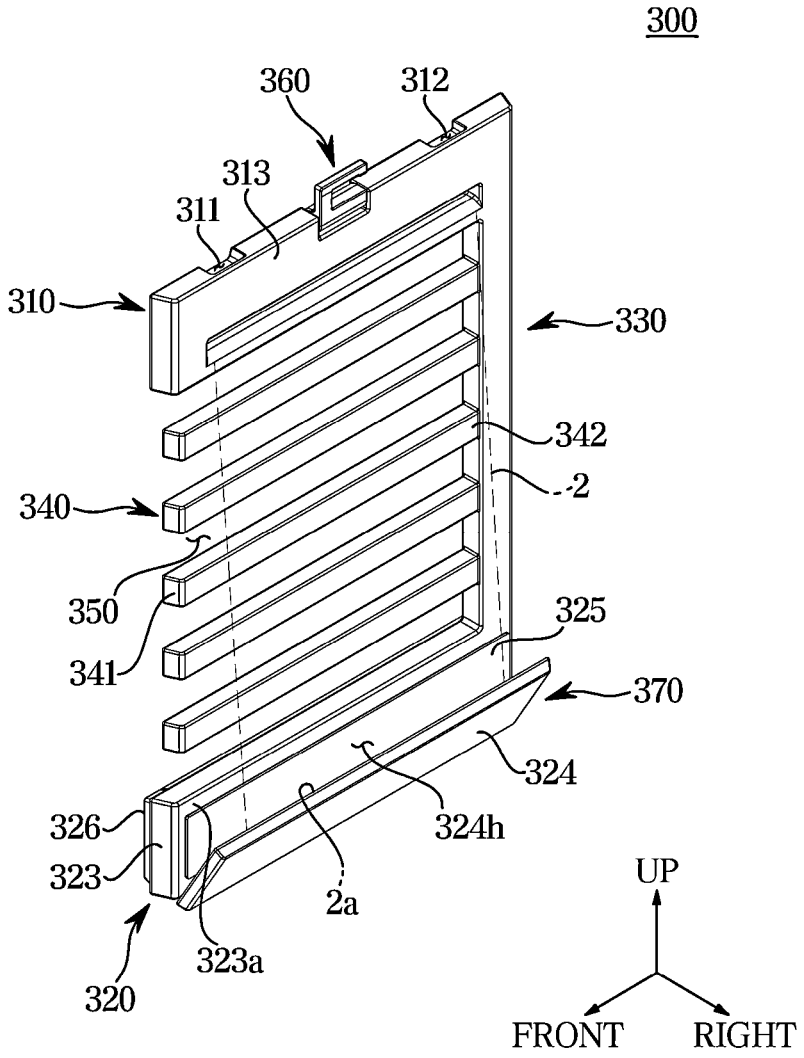
FIGS. 18 to 21 illustrate that clothes are supported on the shelf frame shown in FIG. 17.
Figure 19:
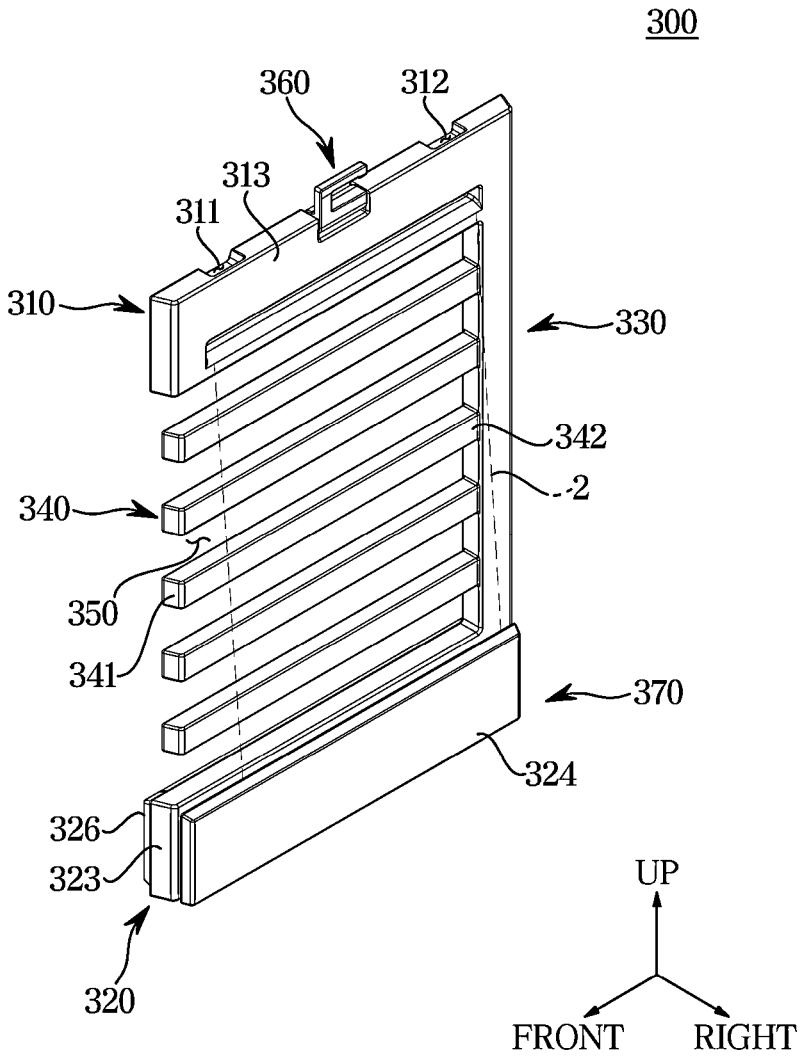
Figure 20:
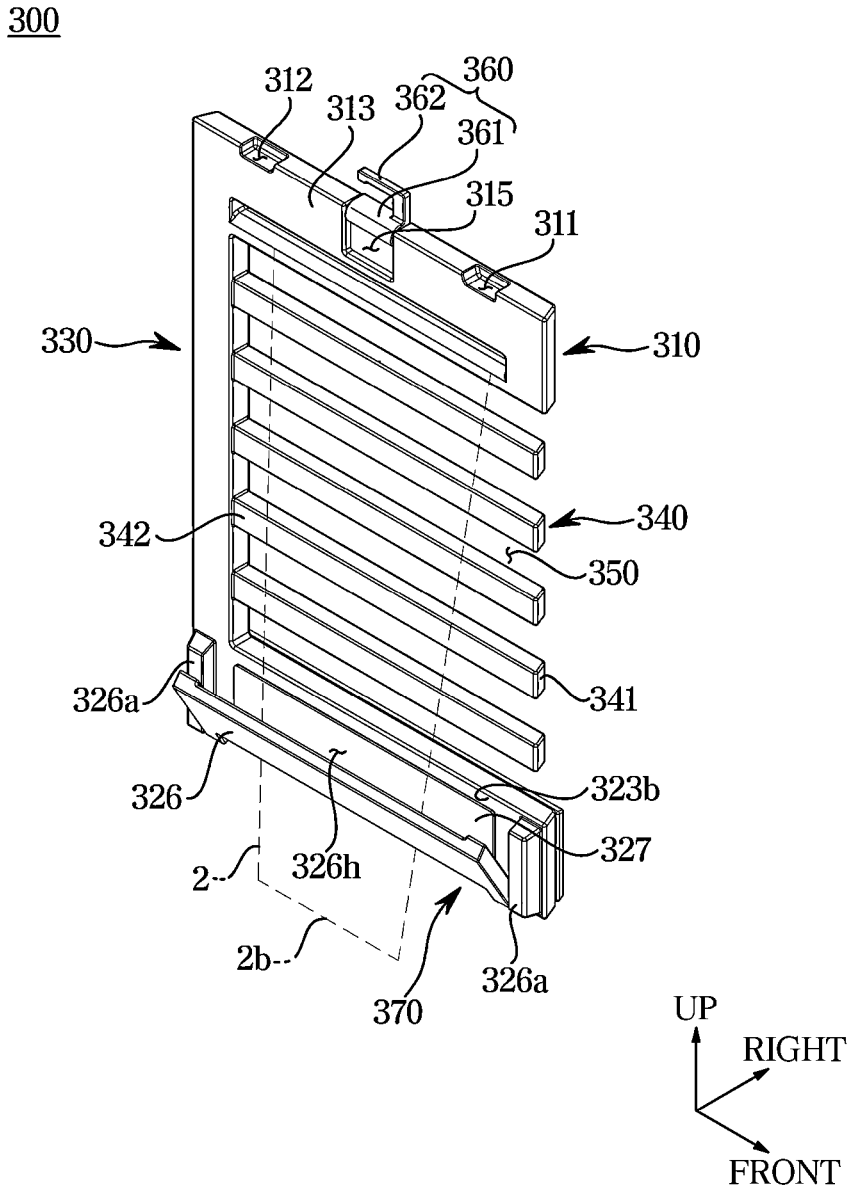
Figure 21:
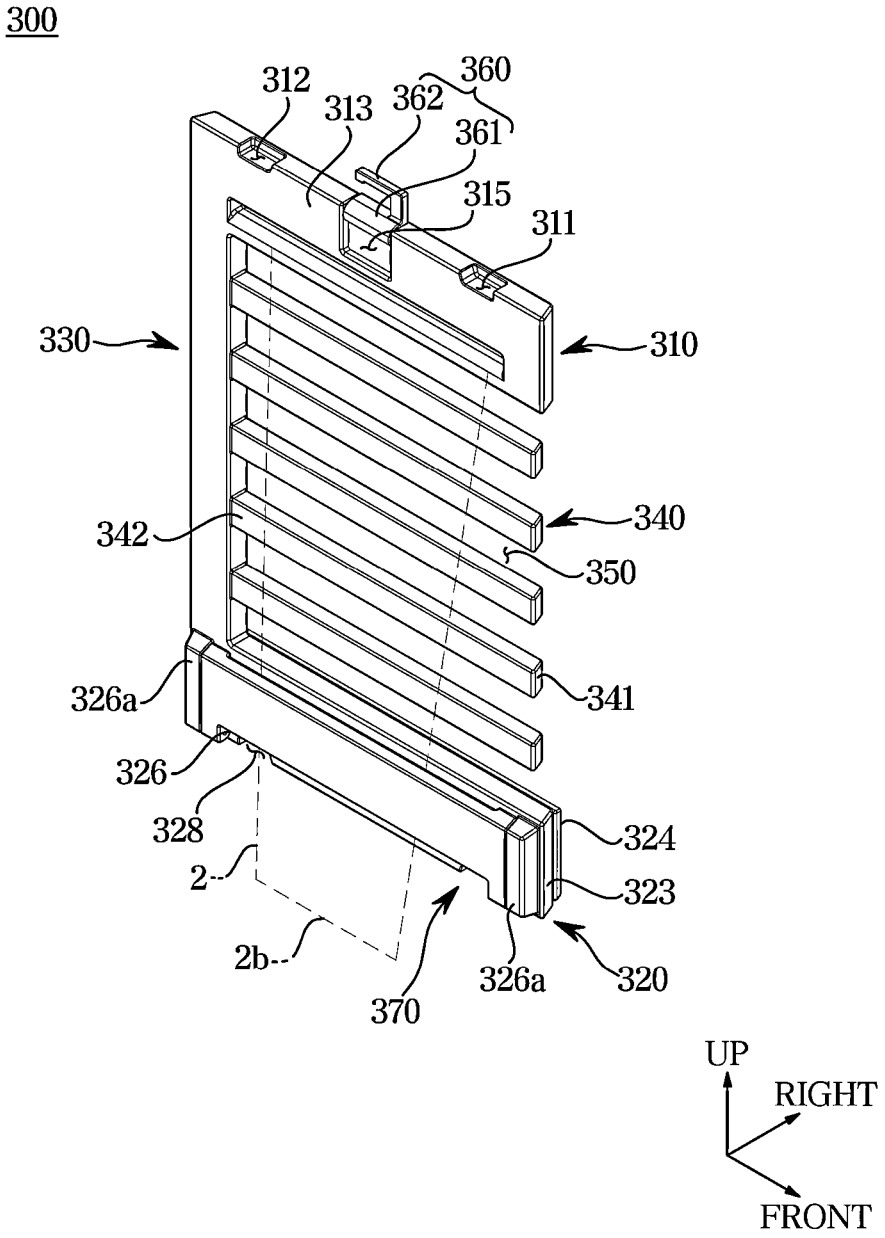

As illustrated in FIG. 12, the shelf frame 100 may be used to be coupled to the first locking member 190. In this case, the hook member 160 may be disposed in the locked position, and the first locking member 190 may be disposed in the position in which the first locking member protrudes to the inside of the care room 30.

In this case, the hook protrusion 162 (see FIG. 6) may be seated in the seating groove 191 (see FIG. 8) of the locking member 190, and the position of the hook protrusion 162 may be fixed by the locking protrusion 192. This structure may be a structure which the first side frame 110 is disposed above the second side frame 120. Because the clothes 2 and the like may be inserted through the open portion 150 to be supported by the at least one support frame 140, convenience may be improved.

A shelf frame 200 according to another example will be described in detail below with reference to FIGS. 13 to 16. Unlike the configuration of the shelf frame 100 according to one example, the shelf frame 200 may be formed in a wire shape.

The shelf frame 200 may include a first side frame 210 and a second side frame 220 capable of being supported by the support members 170, 180, 180*a*, and 180*b*. The shelf frame 200 may include a connection frame 230 connecting rear sides of the first side frame 210 and the second side frame 220.

The connection frame 230 may be formed by combining two wires. That is, the connection frame 230 may include a first connection frame 231 and a second connection frame 232. The first connection frame 231 and the second connection frame 232 may form a space therebetween, and may have a shape in which a rear side of the first side frame 210 and a rear side of the second side frame 220 are bent and inserted through the space.

The first side frame 210 may include a wire body 212 capable of extending along an edge to form a groove 211 therein. The first side frame 210 may include a hook housing 270 connected to the wire body 212. Unlike illustrated in the drawings, the hook housing 270 may be included in the second side frame 220.

The groove 211 may be formed to extend in the front-rear direction so that the front support protrusions 171, 181, 181*a*, and 181*b*, and the rear support protrusions 172, 182, 182*a*, and 182*b* of the support members 170, 180, 180*a*, and 180*b* are inserted therein. In this case, the wire body 212 may press the support protrusions 171, 172, 181, 182, 181*a*, 182*a*, 181*b*, and 182*b* inserted into the groove 211.

Unlike a front end 210*a* of the first side frame 210, a portion adjacent to a rear end 210*b* may be bent to be capable of being inserted between the first connection frame 231 and the second connection frame 232. In this case, the first connection frame 231 and the second connection frame 232 may press the portion adjacent to the rear end 210*b* of the first side frame 210.

A configuration of the second side frame 220 may be provided to correspond to the configuration of the first side frame 210 described above.

The shelf frame 200 may include at least one support frame 240 capable of extending in the first direction between the first side frame 210 and the second side frame 220 and being arranged in the second direction.

Herein, the first direction and the second direction may be the first direction corresponding to an extending direction of the first side frame 210 and the second side frame 220 in the drawings and the second direction intersecting the first direction but are not limited thereto, and the second direction may be an extending direction of the connection frame 230.

The at least one support frame 240 may be a wire extending along an edge to form a groove therein. The support frames 240 may be spaced apart from each other and may have an open portion 250 provided to be adjacent to a front end 241.

The front end 241 of the at least one support frame 240 may be bent upward, and a rear end 242 may be inserted into a space between the first connection frame 231 and the second connection frame 232. According to this structure, when an item is supported on an upper side of the at least one support frame 240, the item may be prevented from falling to a front side thereof. The rear end 242 of the at least one support frame 240 may keep a stable shape by being coupled to the connection frame 230.

The shelf frame 200 may include the hook housing 270 and a hook member 260 connected to the wire body 212 of the first side frame 210. The hook member 260 may not only be formed to be coupled to the first locking member 190 and the second locking member 190*a*, or the support bar 61, but also may be coupled to any member as long as the member may be held (see FIGS. 9 to 12).

The hook housing 270 may be formed in a separate configuration from the wire body 212 of the first side frame 210. The hook housing 270 may be formed so as not to protrude to the outside of the shelf frame 200 compared to the wire body 212 of the first side frame 210. The hook housing 270 may include the hook member 260 and a hook accommodating groove 275 capable of accommodating the hook member 260.

According to this configuration, because the shelf frame 200 may include the rotatable hook member 260 even when formed in a wire shape, the shelf frame 200 may be disposed in various arrangements within the care room 30 (see FIG. 2). Therefore, user convenience and satisfaction may be improved.

The hook member 260 may be movable between the accommodated position in which the hook member is accommodated within the hook accommodating groove 275 and the locked position in which the hook member is coupled with the locking member 190 and 190*a* (see FIG. 9). When the hook member 260 is disposed in the locked position in which the hook member is coupled with the locking members 190 and 190*a*, the hook member 260 may protrude to the outside of the shelf frame 200. When the hook member 260 is disposed in the accommodated position, the hook member 260 may be accommodated within the hook housing 270.

When the hook member 260 is disposed in the locked position, the hook member 260 may also be supported by the support bar 61 (see FIG. 3).

The hook member 260 may be rotatably coupled with respect to the hook housing 270. The hook member 260 may include a rotational coupling part 261 coupled to the hook housing 270 and a hook protrusion 262 formed to protrude rearward from the rotational coupling part 261. An extending direction of the hook protrusion 262 may be formed to face a rear side on which the connection frame 230 is disposed.

Unlike illustrated in the drawings, the hook member 260 may have a wire shape of being formed integrally with the first side frame 210, the second side frame 220, or the connection frame 230. The hook member 260 may have a sliding structure to be capable of protruding toward the outside of the shelf frame 200 from the hook housing 270 coupled to the first side frame 210, the second side frame 220, or the connection frame 230, but is not limited thereto.

The hook accommodating groove 275 of the shelf frame 200 may be formed on a lower side when the shelf frame 200 is supported by support members 170, 180, 180*a*, and 180*b* (see FIG. 9) to be similar to the configuration of the shelf frame 100 according to one example. However, the present disclosure is not limited thereto.

A shelf frame 300 according to another example will be described in detail below with reference to FIGS. 17 to 21. Descriptions of configurations of the shelf frame 300 corresponding to the configurations of the shelf frame 100 according to one example will be omitted.

A hook member 360 disposed on a first side frame 310 side of the shelf frame 300 may be included, and a clamp 370 formed on a second side frame 320 side may be included.

The clamp 370 may be provided to secure a position of the clothes 2 supported by the shelf frame 300. The clamp 370 may include covers 324 and 326 rotatably coupled to the second side frame 320. The clamp 370 may include coupling plates 325 and 327 disposed on the second side frame 320 to fix the clothes 2 to the second side frame 320.

The covers 324 and 326 may include the first cover 324 and the second cover 326. The first cover 324 may be formed to be larger than the second cover 326, and the first cover 324 and the second cover 326 may be provided on one side or the other side of the second side frame 320.

A size of the first cover 324 may be formed to correspond to or be smaller than a side body 323 of the second side frame 320, and the first cover 324 may be rotatably coupled with respect to one surface 323*a* of the side body 323. A portion to which the first cover 324 and the side body 323 are coupled may be one side of the shelf frame 300. Herein, the one side may be a side opposite to the other side of the shelf frame 300 on which the hook member 360 may be provided.

The first cover 324 may include a first rotational coupling part 324*a* coupled to the side body 323. That is, the first cover 324 may be open on the other side facing the at least one support frame 340 with respect to the first rotational coupling part 324*a* disposed on the one side.

The second cover 326 may be formed to be smaller than the side body 323. That is, the second cover 326 may face a different direction from the first cover 324, and the first cover 324 may be coupled to the first surface 323*a* of the side body 323, and the second cover 326 may be coupled to a second surface 323*b* of the side body 323.

The second cover 326 may be rotatably coupled with respect to the side body 323, and more detail, may be rotationally coupled to second rotational coupling parts 326*a* formed on left and right sides of the second cover 326.

The second cover 326 may be rotatably coupled to lower sides of the second rotational coupling parts 326*a*, and the lower sides may be one sides adjacent to the first rotational coupling part 324*a*.

The second cover 326 is fixed to the one sides of the second rotational coupling part 326*a*, so that the other side of the second cover facing the first side frame 310 may be opened. Unlike the first cover 324, an opening 328 may be formed on a lower side of the second cover 326.

The coupling plates 325 and 327 may include the first coupling plate 325 capable of being coupled to the first surface 323*a* of the side body 323, and the second coupling plate 327 capable of being coupled to the second surface 323*b*. The coupling plates 325 and 327 may be provided to be smaller than the side body 323.

Although not illustrated in the drawings, the first coupling plate 325 may be coupled to one surface of the first cover 324 adjacent to the first surface 323*a*, and the second coupling plate 327 may be coupled to one surface of the second cover 326 adjacent to the second surface 323*b*. Herein, the one surface of the first cover 324 or the one surface of the second cover 326 may be a surface adjacent to the side body 323.

The present disclosure is not limited thereto, and the first coupling plate 325 may be coupled to both the first cover 324 and the first surface 323*a* of the side body 323, and the second coupling plate 327 may be coupled to both the second cover 326 and the second surface 323*b* of the side body 323.

Hereinafter, a process in which the clothes 2 are supported by the shelf frame 300 when the at least one support frame 340 is arranged in the up-down direction will be described in detail.

When the at least one support frame 340 is arranged in the up-down direction, the hook member 360 may be in the position in which the locking member protrudes to the outside of the shelf frame 300. In this case, the first rotational coupling part 324*a* may be disposed at a lower portion of the first cover 324. The lower portion of the first cover 324 may not be opened, and only an upper portion thereof may be opened.

The clothes 2 may be placed on one side and the other side of the shelf frame 300 throughout the at least one support frame 340.

A first opening 324*h* may be formed in an open portion of the first cover 324, and one end 2*a* of the clothes 2 may be inserted into the first opening 324*h*. Thereafter, the first cover 324 may be closed again by the first rotational coupling part 324*a* and coupled to the first surface 323*a* of the side body 323.

As such, an elastic member is provided on the first rotational coupling part 324*a* so that the first rotational coupling part 324*a* may be closed again to fix the clothes 2, thereby providing an elastic force for rotation. Alternatively, the first rotational coupling part 324*a* may be provided with a locking structure or a magnet so that the first cover 324 may be fixed in a closed position.

The first coupling plate 325, which is coupled to the first surface 323*a* of the side body 323 and has a smaller shape than the side body 323, may fix the clothes 2 to the second side frame 320. This is to remove wrinkles by fixing the one end 2*a* of the clothes 2 to the second side frame 320.

Thereafter, as the second cover 326 is opened, the other end 2*b* of the clothes 2 may be inserted into a second opening 326*h*. The other end 2*b* of the clothes 2 may be inserted into the opening 328 provided on the lower side of the second cover 326 and protrude further downward than the second cover 326.

Thereafter, as the second cover 326 is closed again by the second rotational coupling part 326*a*, the second cover 326 may be coupled to the second surface 323*b* of the side body 323. Like the first rotational coupling part 324*a* described above, the second rotational coupling part 326*a* may also be provided with an elastic member, a locking structure, or a magnet so that the second cover 326 may be fixed in a closed position.

The second coupling plate 327 coupled to the second surface 323*b* of the side body 323 may fix the clothes 2 to the second surface 323*b*. Accordingly, a portion of clothes 2 adjacent to the one end 2*a* and the other end 2*b* is fixed to the second side frame 320, so that wrinkles in the clothes 2 may be removed.

The present disclosure is not limited to what is illustrated in the drawings, and the hook member 360 may be provided on the one side of the shelf frame 300 and the clamp 370 may be provided on the other side.

A shelf frame 400 according to another example will be described in detail below with reference to FIGS. 22 and 23. The shelf frame 400 may be configured such that a first side frame 410 may be supported by one configuration of the third support members 180*a* and 180*b* disposed on the right surface 12*c* (see FIG. 9) of the care room 30. A second side frame 420 may be supported by the first support member 170 or the second support member 180 disposed on the left surface 12*d* of the care room 30. A hook member 460 may be provided to be adjacent to the first side frame 410.

The shelf frame 400 may include connection frames 430 and 470 connecting the first side frame 410 and the second side frame 420. The connection frames 430 and 470 may include the first connection frame 430 and the second connection frame 470.

Figure 22:
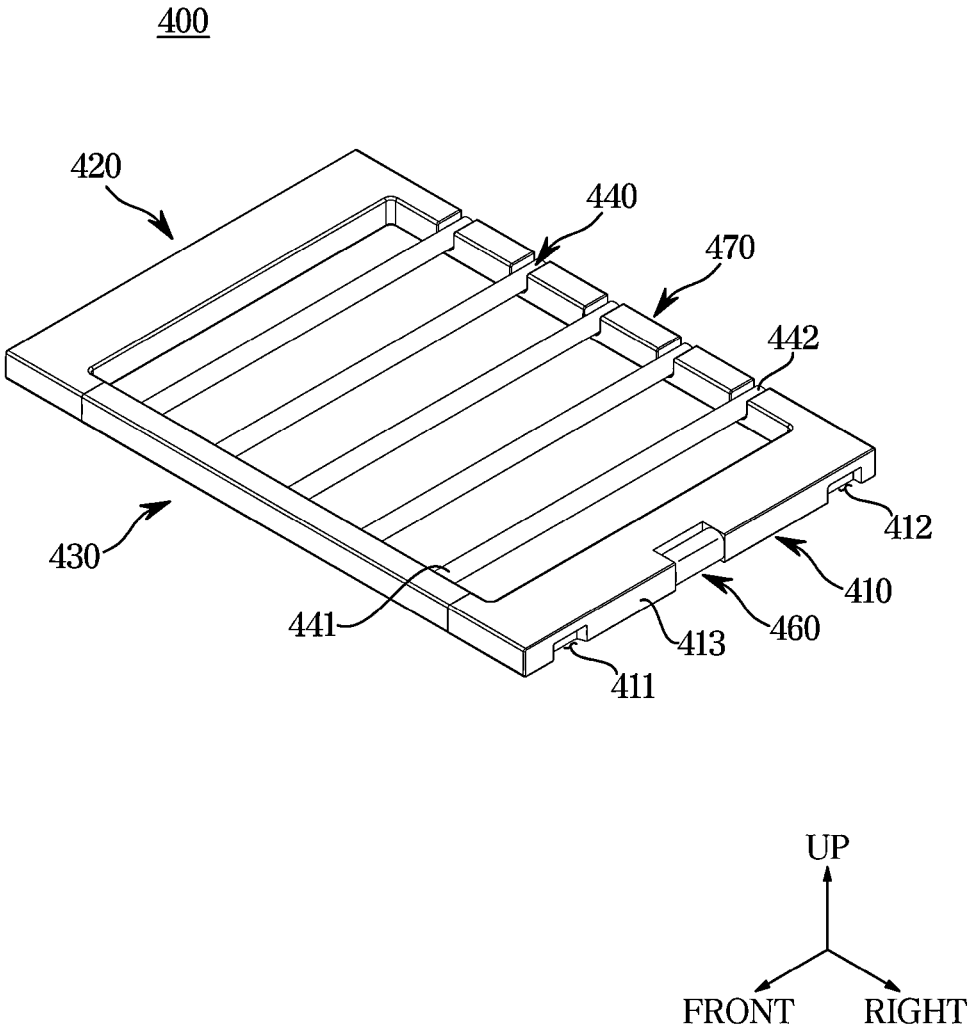
FIG. 22 illustrates a shelf frame according to another example.

As illustrated in FIG. 22, the first connection frame 430 may be provided on a front side of at least one support frame 440, and the second connection frame 470 may be provided on a rear side of the at least one support frame 440. The first connection frame 430 and the second connection frame 470 may be arranged side by side with each other.

One end 441 of the at least one support frame 440 may be connected to the first connection frame 430, and the other end 442 may be connected to the second connection frame 470. That is, one side of the at least one support frame 440 may be connected to the first connection frame 430, and the other side may be connected to the second connection frame 470.

Figure 23:
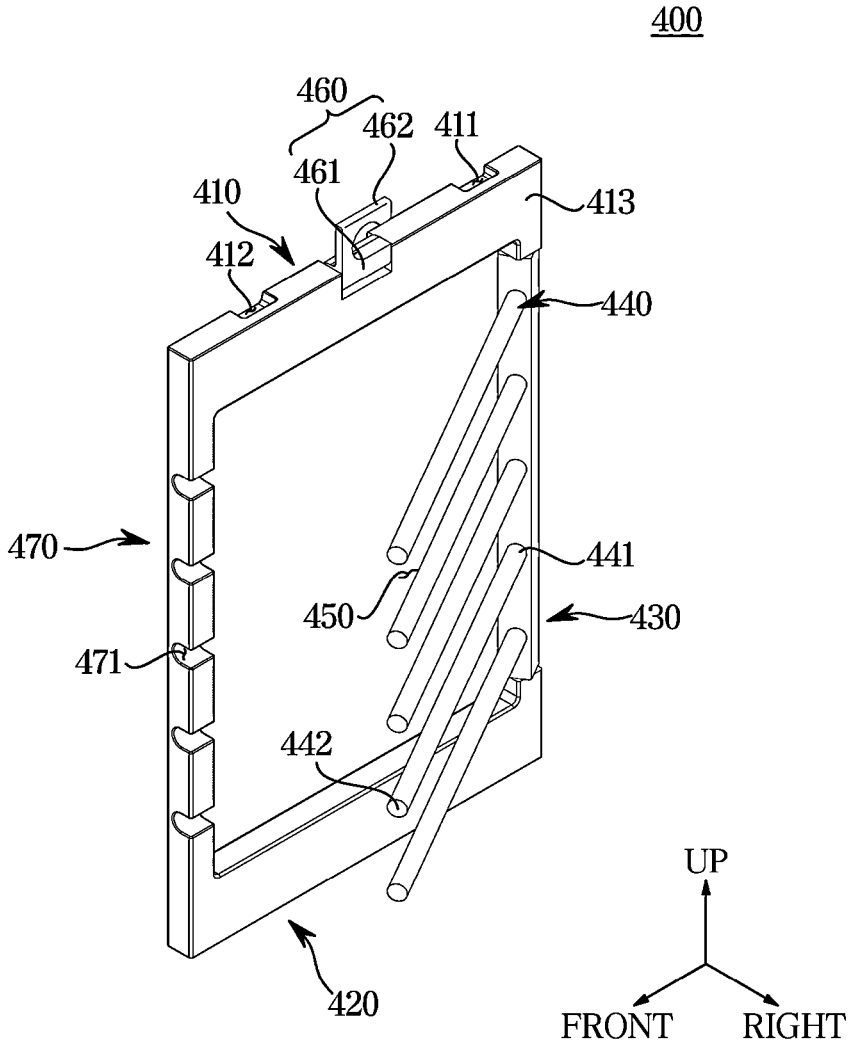
FIG. 23 illustrates that an open portion of the shelf frame shown in FIG. 22 is being opened or closed.

When the hook member 460 is supported by the locking members 190 and 190*a* or the support bar 61, as illustrated in FIG. 23, the first connection frame 430 may be provided on the rear side of the at least one support frame 440 (see FIGS. 9 to 12). In this case, the second connection frame 470 may be provided on the front side of the at least one support frame 440.

In this case, the second connection frame 470 may be rotatably coupled with respect to the first side frame 410 and the second side frame 420. The one end 441 of the at least one support frame 440 may be coupled to the first connection frame 430, and the other end 442 of the at least one support frame 440 may be moved depending on a movement of the first connection frame 430.

That is, the one end 441 of the at least one support frame 440 may be fixed to the first connection frame 430, and the other end 442 may be moved by the movement of the first connection frame 430. The other end 442 may be capable of being coupled to the second connection frame 470.

When the other end 442 is coupled to the second connection frame 470, an open portion 450 may be closed, and when the other end 442 is separated from the second connection frame 470, the open portion 450 may be opened. A support frame groove 471 into which the at least one support frame 440 may be inserted may be disposed on the second connection frame 470 so that the other end 442 may be detachably coupled to the second connection frame 470. The support frame groove 471 may be modified depending on a shape of the at least one support frame 440.

The support frame groove 471 may be formed to face upward when the shelf frame 400 is supported by the support members 170, 180, 180*a*, and 180*b* (see FIG. 9). According to this configuration, the at least one support frame 440 may be prevented from being separated from the support frame groove 471.

However, the present disclosure is not limited to this configuration, and in order to prevent the first connection frame 430 from being moved due to a slight force, a member such as a rubber member may be added at portions where the first connection frame 430 is coupled to the first side frame 410 and the second side frame 420.

According to this structure, when the shelf frame 400 is supported by the support members 170, 180, 180*a*, and 180*b*, items may be prevented from falling toward the front. In addition, even when the shelf frame is supported by the support bar 61 or the locking members 190 and 190*a*, clothes and the like may be easily inserted through the open portion 450, thereby increasing convenience.

Figure 24:
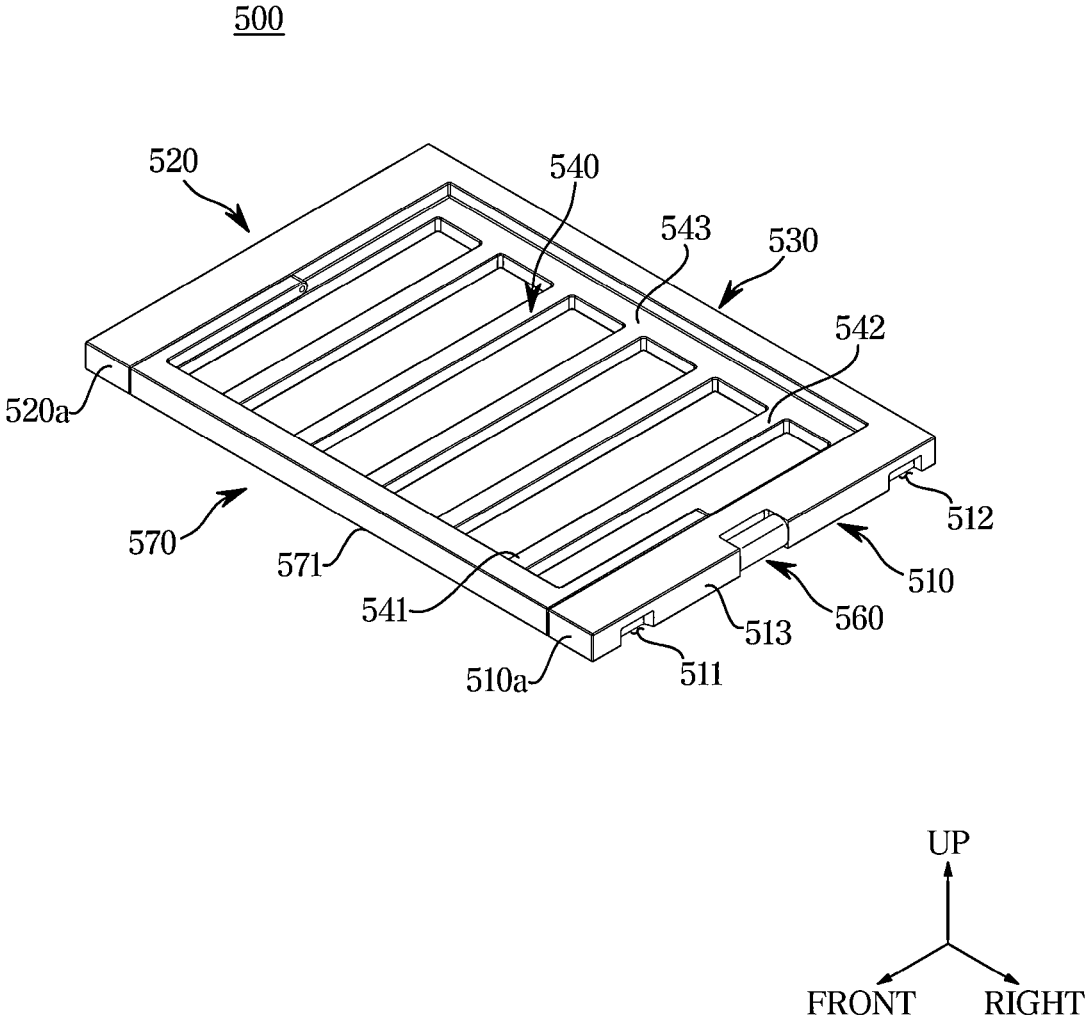
FIG. 24 illustrates a shelf frame according to another example.
Figure 25:
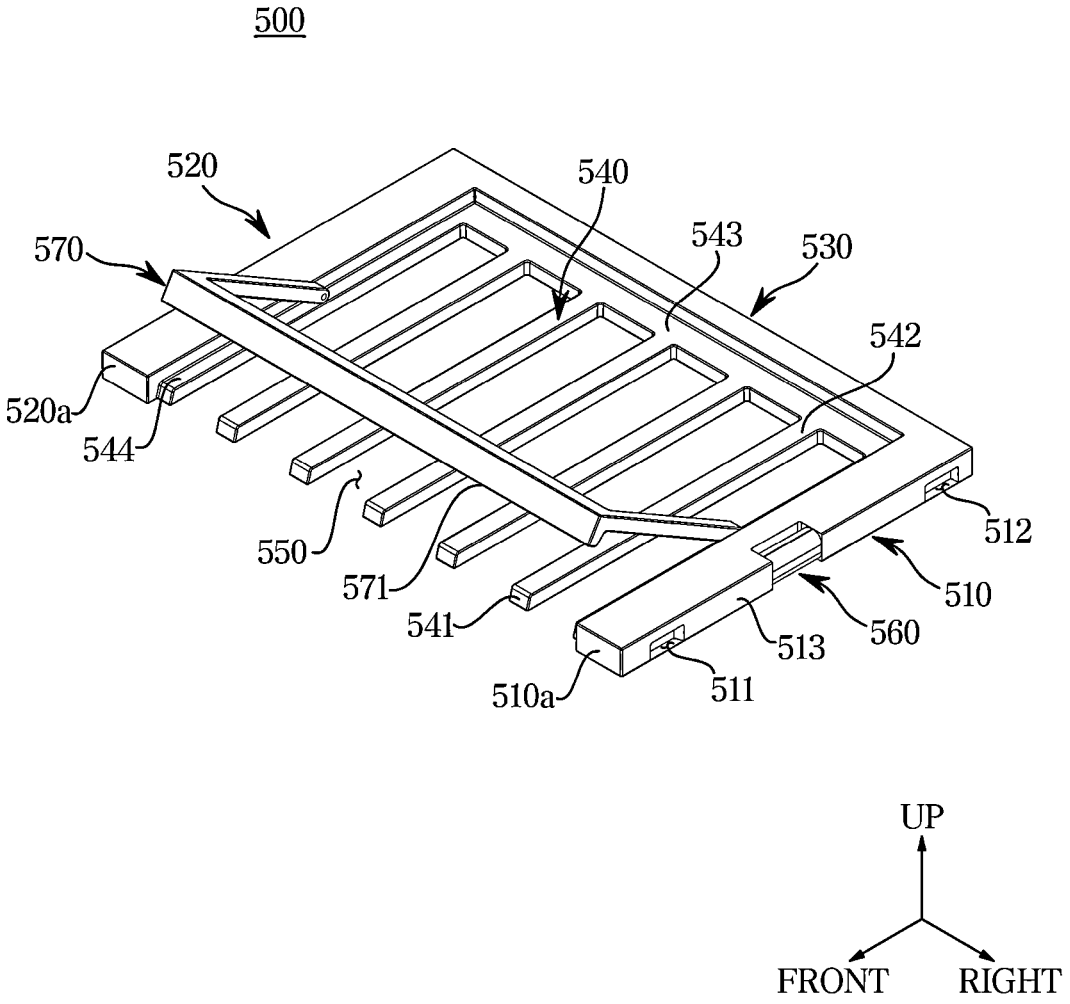
FIGS. 25 and 26 illustrate that an open portion of the shelf frame shown in FIG. 24 is being opened.
Figure 26:
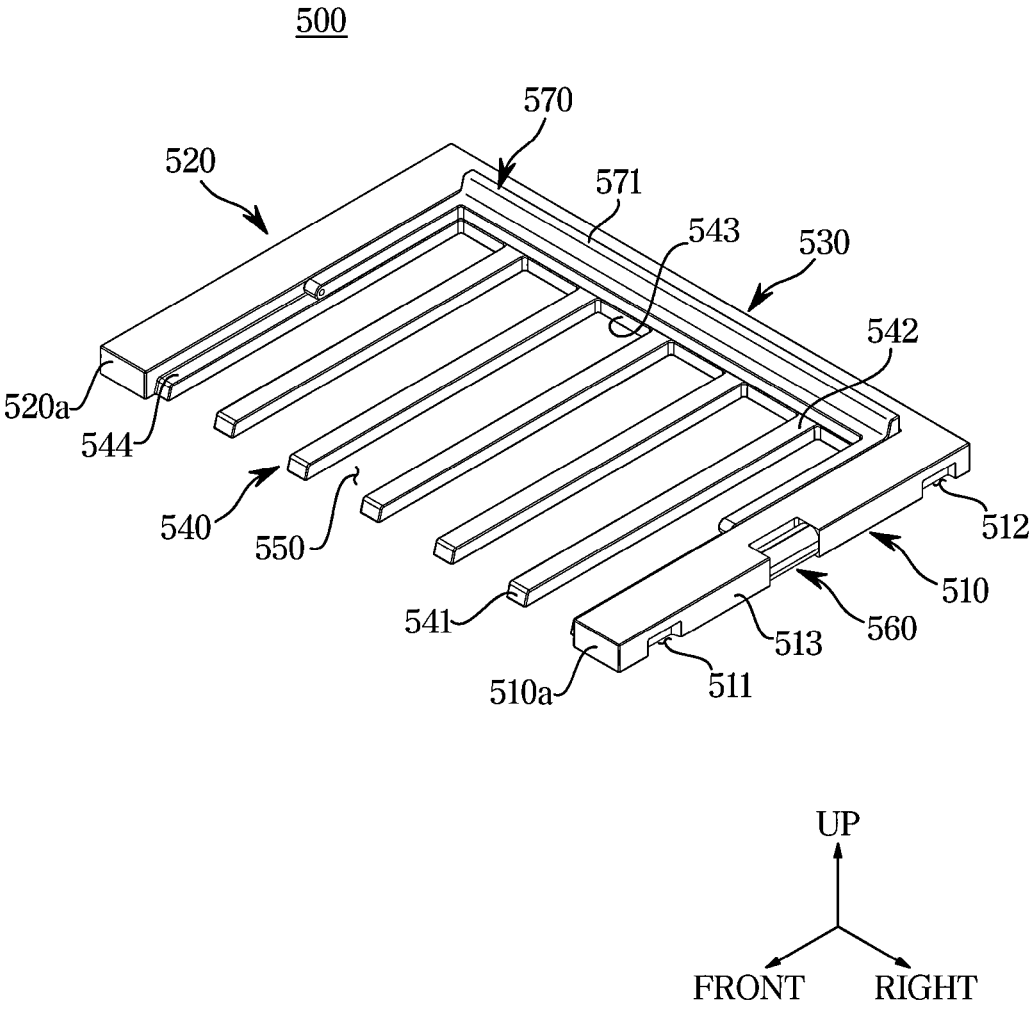

A shelf frame 500 according to another example will be described in detail below with reference to FIGS. 24 to 26. The shelf frame 500 may further include an opening and closing frame 570 capable of opening and closing an open portion 550 formed on a front side of at least one support frame 540.

The opening and closing frame 570 may be coupled to a first side frame 510 and a second side frame 520. More specifically, the shelf frame 500 may include seating frames 543 and 544 provided to be adjacent to the at least one support frame 540 from the first side frame 510, the second side frame 520 and a connection frame 530. The seating frames 543 and 544 may be formed to seat the opening and closing frame 570.

The seating frames 543 and 544 may include the first seating frame 544 provided to be adjacent to the first side frame 510 and the second side frame 520, and the second seating frame 543 provided to be adjacent to the connection frame 530.

The seating frames 543 and 544 may be formed to be smaller than heights of the first side frame 510, the second side frame 520, and the connection frame 530. The at least one support frame 540 may be formed to be smaller than the heights of the first side frame 510, the second side frame 520, and the connection frame 530. The at least one support frame 540 and the seating frames 543 and 544 may have the corresponding heights.

The opening and closing frame 570 may be moved by being coupled to the first side frame 510 and the second side frame 520. The opening and closing frame 570 may be rotatably coupled with respect to the first side frame 510 and the second side frame 520. The opening and closing frame 570 may be movable between an opened position in which the opening and closing frame opens the open portion 550 and a closed position in which the opening and closing frame closes the open portion 550.

More specifically, portions where the opening and closing frame 570 is coupled to the first side frame 510 and the second side frame 520 may be provided between a front support protrusion groove 511 and a rear support protrusion groove 512 of the first side frame 510. The opening and closing frame 570 may be disposed to be adjacent to the at least one support frame 540.

When one end 571 of the opening and closing frame 570 is disposed further forward than the at least one support frame 540, the opening and closing frame 570 may be disposed in a closed position in which the opening and closing frame closes the open portion 550. When the opening and closing frame 570 is rotated and seated on the second seating frame 543, the opening and closing frame 570 may be disposed in the opened position in which the opening and closing frame opens the open portion 550.

When the opening and closing frame 570 is disposed in the closed position, the opening and closing frame 570 may be supported by a front portion of the first seating frame 544. A case in which the opening and closing frame 570 is disposed in the opened position may be a case in which the opening and closing frame 570 is supported by a rear portion of the first seating frame 544 and the second seating frame 543.

When the opening and closing frame 570 is disposed in the closed position, the one end 571 of the opening and closing frame 570 may be disposed further forward than an one end 541 of the at least one support frame 540.

A front end 510*a* of the first side frame 510 and a front end 520*a* of the second side frame 520 may protrude further than the one end 541 of the at least one support frame 540. When the opening and closing frame 570 is disposed in the closed position, front sides of the front ends 510*a* and 520*a* of the first and second side frames 510 and 520 may not protrude compared to the one end 571 of the opening and closing frame 570.

Although the drawings illustrate the movement of the opening and closing frame 570 based on when the shelf frame 500 is supported by the support members 170, 180, 180*a*, and 180*b*, when the shelf frame 500 is supported by the locking members 190 and 190*a* or the support bar 61, the opening and closing frame 570 may be moved (see FIGS. 9 to 12).

According to this structure, the open portion 550 may be opened and closed so that items may be stably supported or clothes may be easily inserted, thereby increasing convenience.

Figure 27:
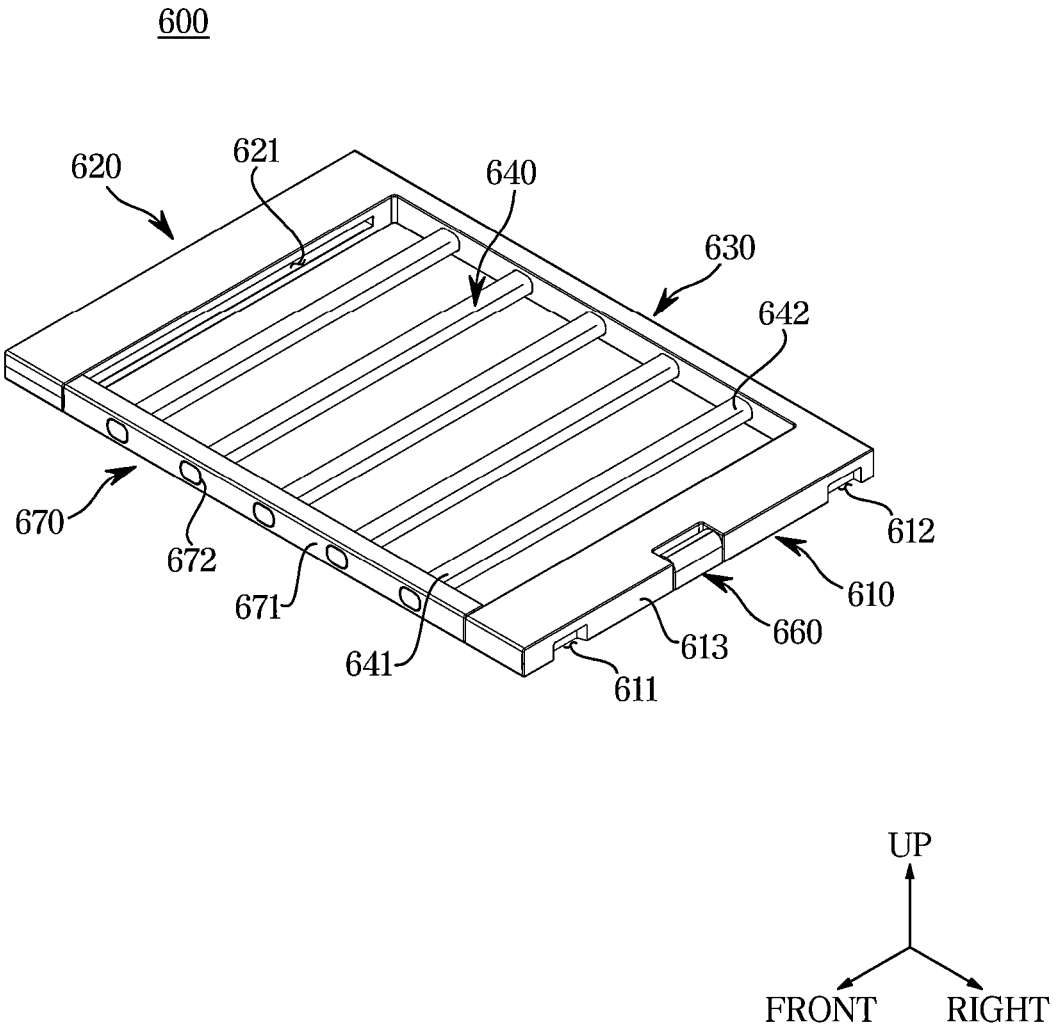
FIG. 27 illustrates a shelf frame according to another example.
Figure 28:
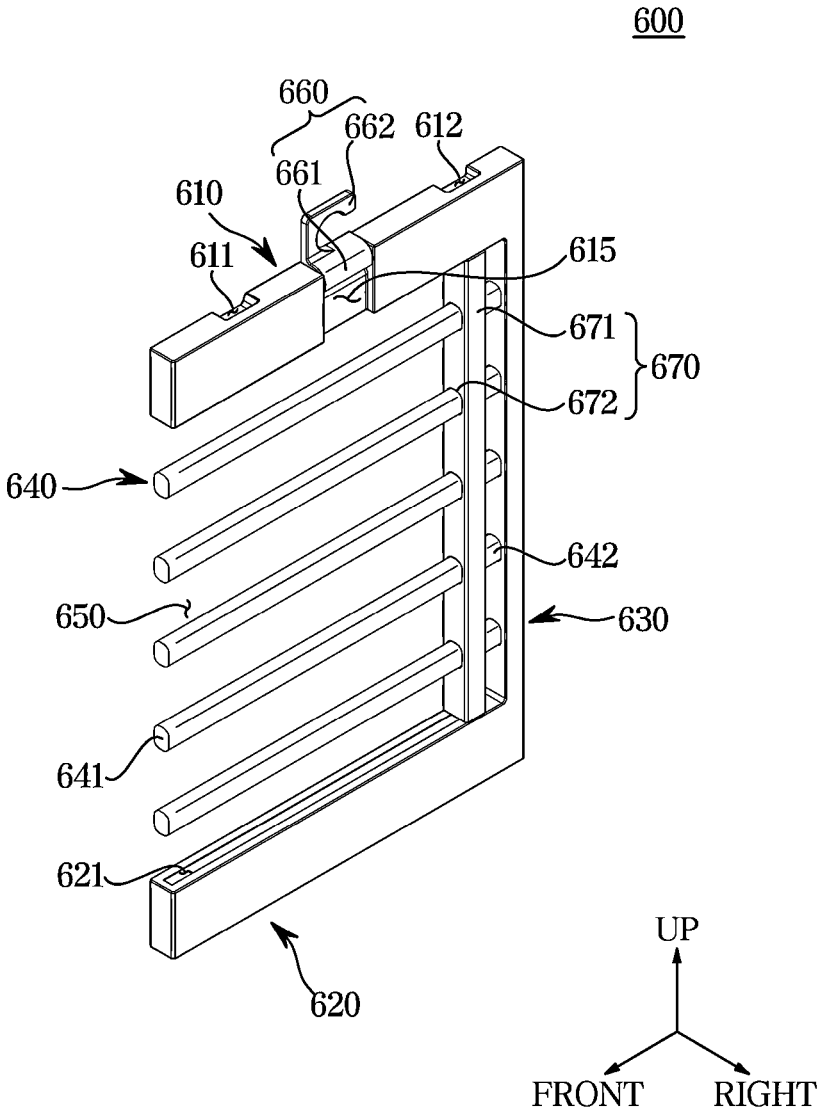
FIG. 28 illustrates that an open portion of the shelf frame shown in FIG. 27 is being opened.

A shelf frame 600 according to another example will be described in detail below with reference to FIGS. 27 and 28. The shelf frame 600 may include an opening and closing frame 670 provided to open and close an open portion 650 formed on a front side of at least one support frame 640.

The opening and closing frame 670 may include an opening and closing body 671 disposed side by side with a connection frame 630 and an insertion hole 672 into which at least one support frame 640 may be inserted.

The opening and closing frame 670 may be moved forward and rearward along a guide groove 621 formed on a first side frame 610 and a second side frame 620. In this case, the opening and closing frame 670 may be moved forward and rearward while the at least one support frame 640 is inserted into the insertion hole 672.

When the opening and closing frame 670 is moved to a front end 641 side of the at least one support frame 640, the opening and closing frame 670 may be disposed in a closed position in which the open portion 650 is closed. When the opening and closing frame 670 is moved to a rear end 642 side of the at least one support frame 640, the opening and closing frame 670 may be disposed in an opened position in which the open portion 650 is opened.

The effects of this structure are the same as described above.

Figure 29:
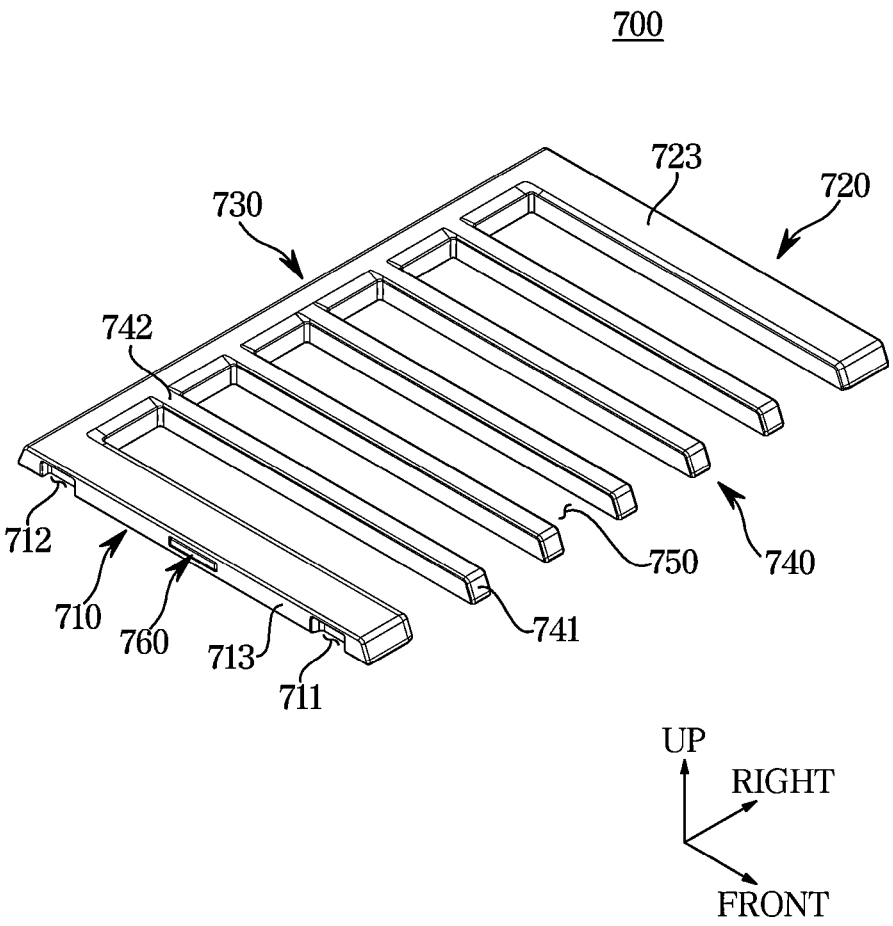
FIG. 29 illustrates a shelf frame according to another example.
Figure 30:
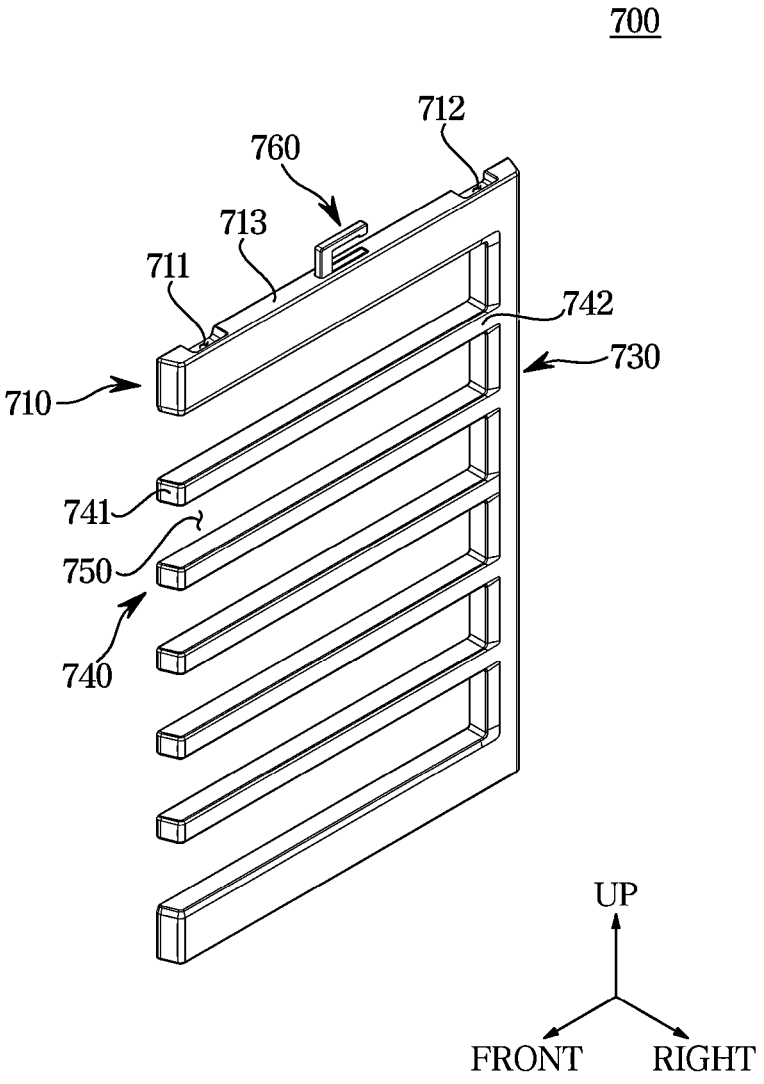
FIGS. 30 and 31 illustrate the shelf frame when a hook member shown in FIG. 29 is disposed in the locked position.
Figure 31:
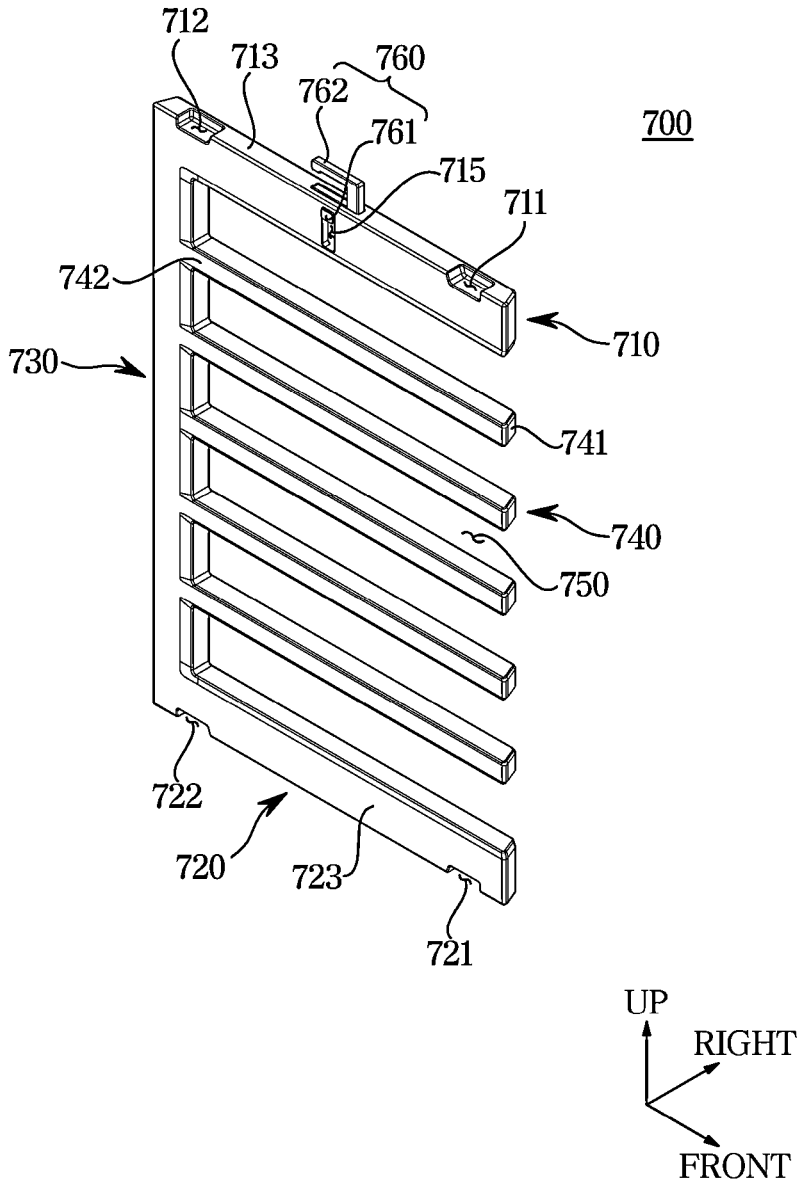

A shelf frame 700 according to another example will be described in detail below with reference to FIGS. 29 to 31. Unlike the shelf frame 100 according to one example, the shelf frame 700 may have a configuration in which a hook member 760 slides.

Unlike illustrated in FIGS. 4 to 7, a hook member 760 may not be rotatably provided on side frames 710 and 720 or a connection frame 730 of the shelf frame 700. For example, the hook member 760 may be structured to slide from the side frames 710 and 720 or the connection frame 730 toward the outside of the shelf frame 700.

More specifically, the hook member 760 may be structured to slide toward the outside of the shelf frame 700 when the hook member 760 is disposed in the locked position. According to this structure, a sliding groove may be formed in a hook member accommodating groove 715 of the first side frame 710 to guide the hook member 760.

In the sliding groove in the hook member accommodating groove 715, an elastic member may be provided as described above, or a separate locking structure may be provided.

Also, the present disclosure is not limited thereto, and when the hook member 760 is provided on the second side frame 720, the sliding groove may be provided on the second side frame 720, and when the hook member 760 is provided on the connection frame 730, the sliding groove may also be provided inside the connection frame 730.

Figure 32:
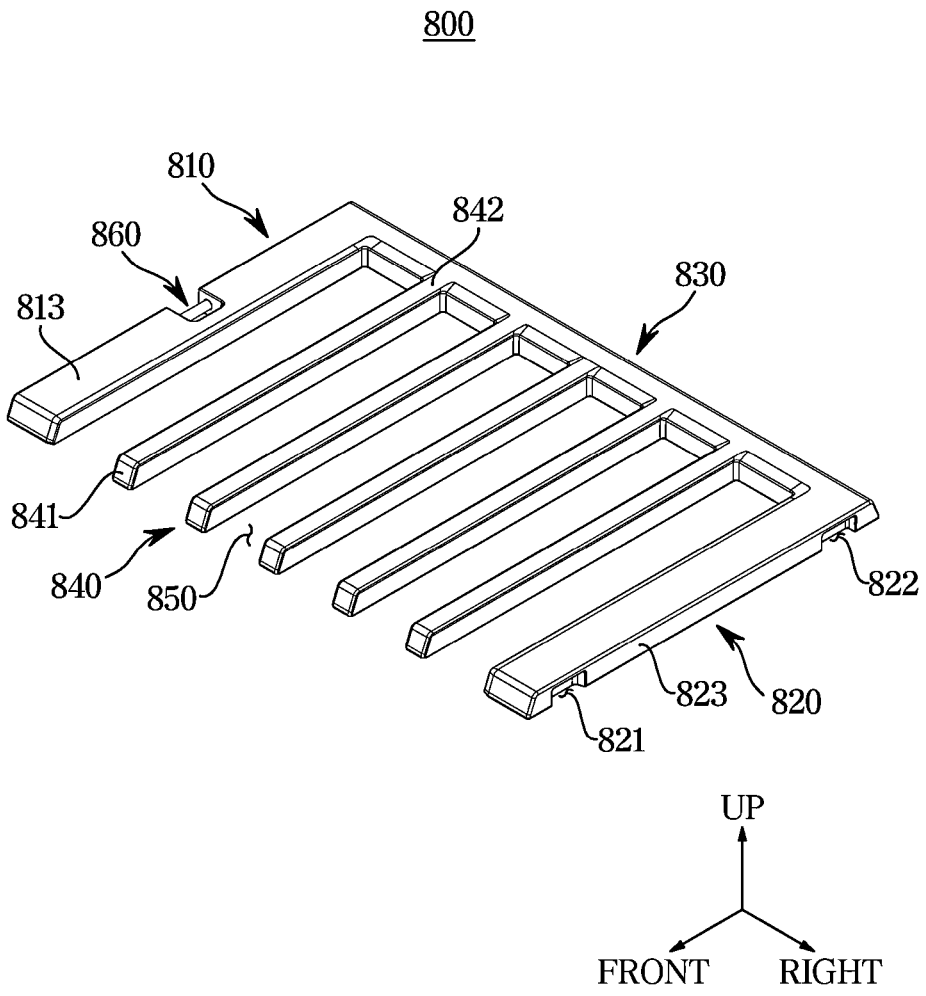
FIGS. 32 and 33 illustrate a shelf frame according to another example.
Figure 33:
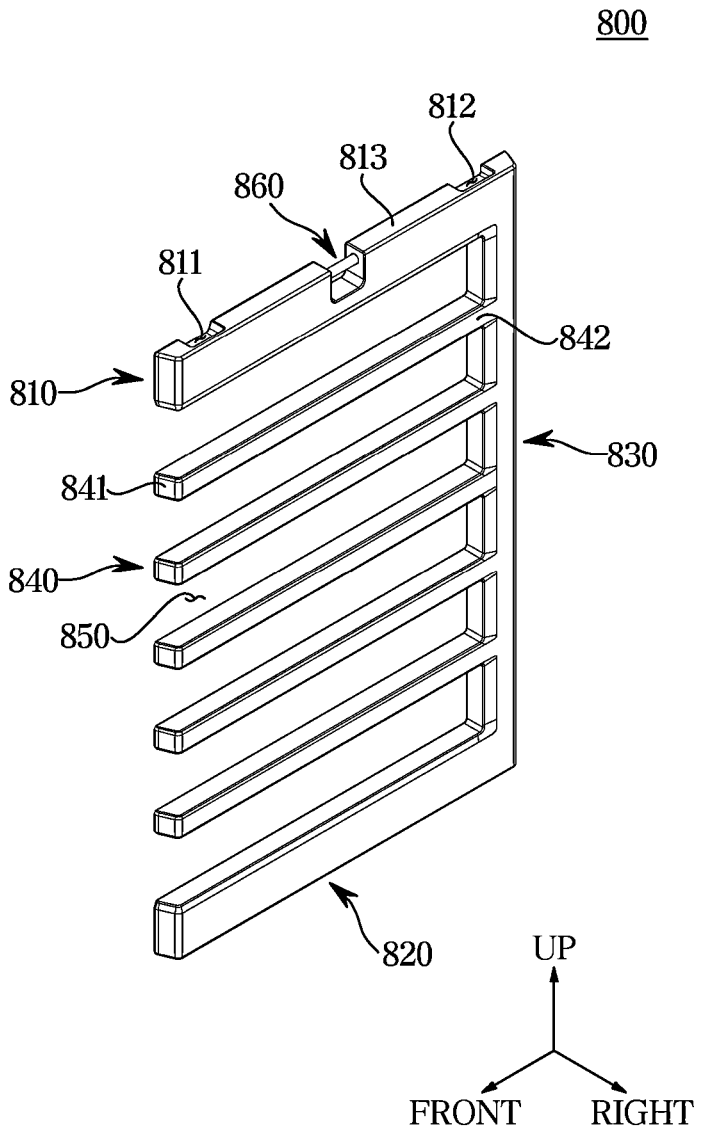
Figure 34:
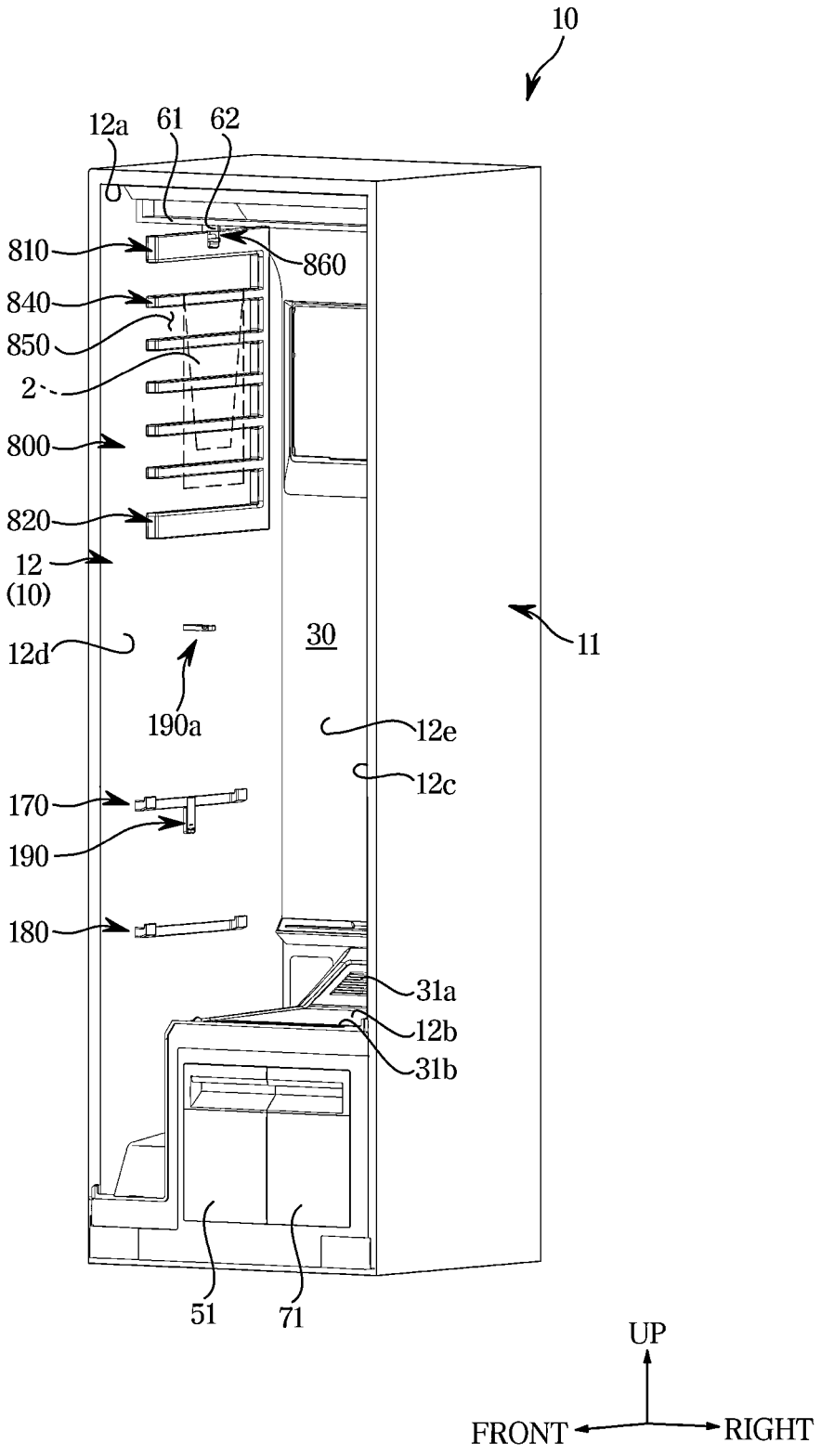
FIG. 34 illustrates that the shelf frame shown in FIG. 33 is coupled to the support bar.

Referring to FIGS. 32 and 33, a shelf frame 800 according to another example may include a coupling bar 860, unlike the hook member 160 according to one example. The coupling bar 860 may have a configuration capable of being coupled to the locking members 190 and 190*a* or the support bar 61.

More specifically, the coupling bar 860 may have a configuration capable of being supported in the seating grooves 191 and 191*a* of the locking members 190 and 190*a*.

In this case, the shelf frame 800 may be disposed along the up-down direction of the care room 30 to correspond to various arrangements of the shelf frame 100 according to one example. That is, when a connection frame 830 of the shelf frame 800 extends in the up-down direction of the care room 30, at least one support frame 840 also may extend in the front-rear direction of the care room 30.

As illustrated in FIG. 33, the coupling bar 860 may have a structure capable of being coupled to a hook member 62 provided on the support bar 61. According to this structure, the shelf frame 800 does not include a hook member and may include the coupling bar 860 in various forms.

The support bar 61 may include the hook member 62, and the coupling bar 860 may be coupled to and supported by the hook member 62 of the support bar 61.

Unlike illustrated in the drawings, the configuration of the hook member may not be provided on the shelf frame 800, and may be structured to be provided on the support members 170, 180, 180*a*, and 180*b* to be coupled to the coupling bar 860. The effects of this structure are the same as described above.

Figure 35:
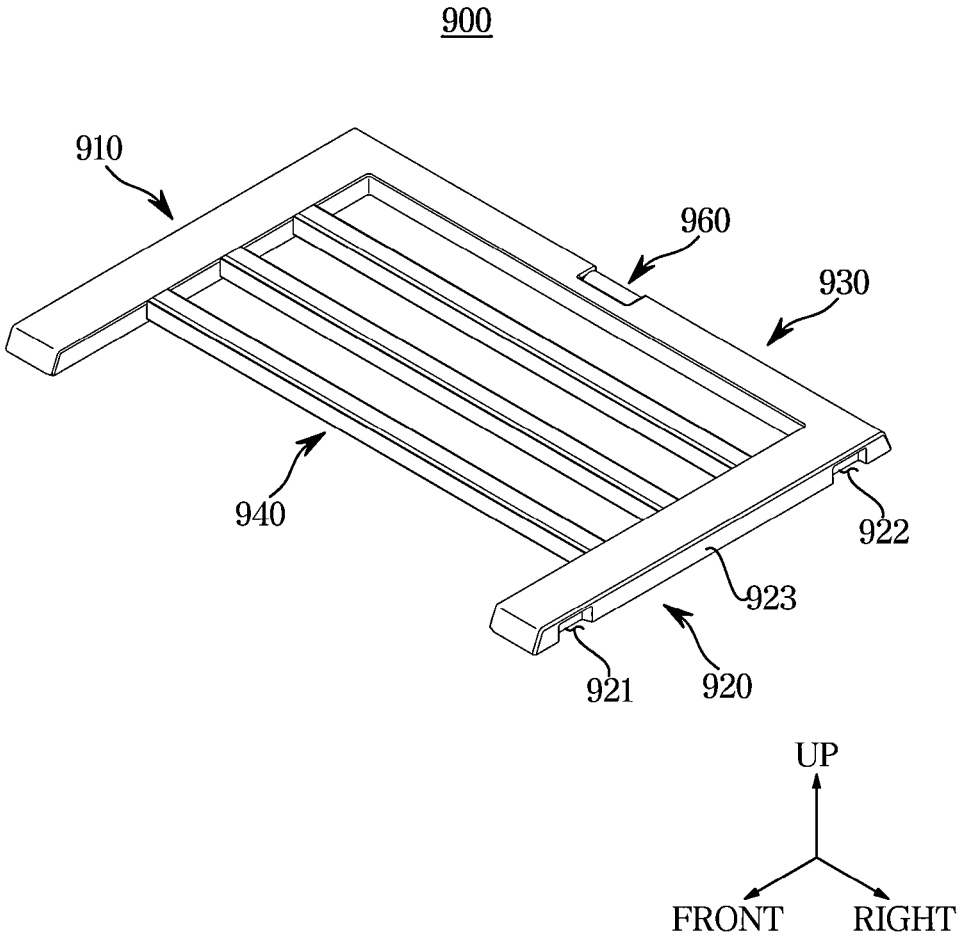
FIGS. 35 and 36 illustrate a shelf frame according to another example.
Figure 36:
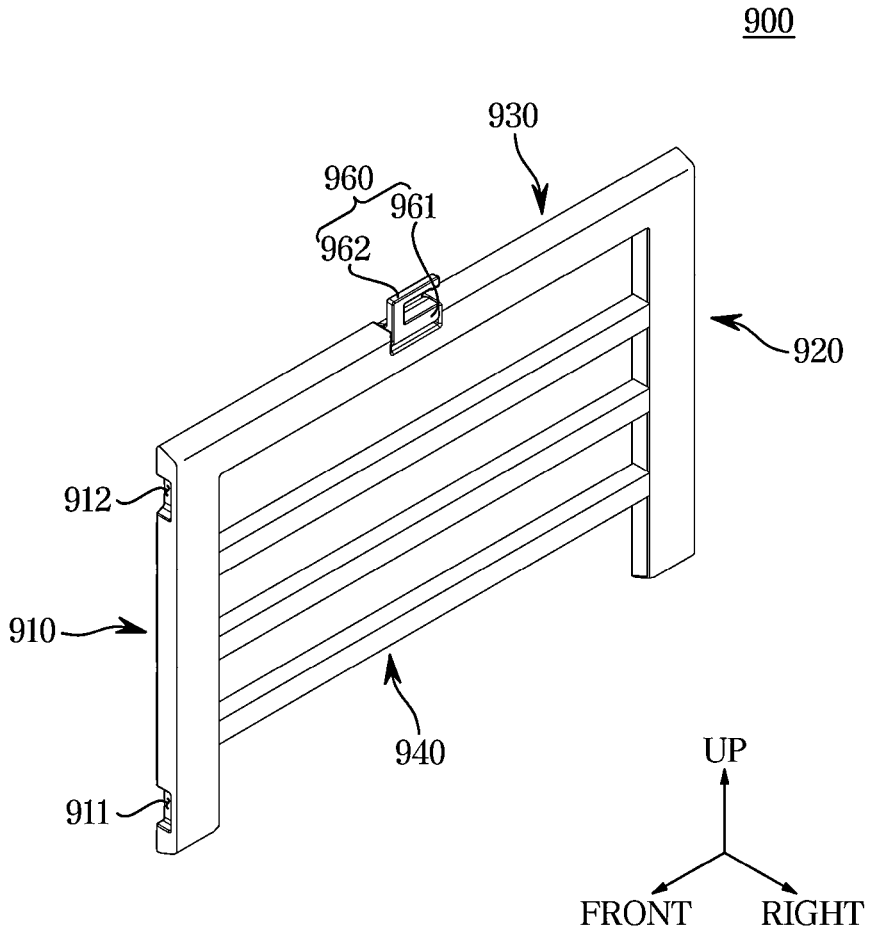

A shelf frame 900 according to another example will be described below with reference to FIGS. 35 and 36. In the shelf frame 900, unlike the shelf frame 100 according to one example, a hook member 960 may be formed on a connection frame 930 side.

Additionally, at least one support frame 940 may extend in the first direction and be arranged in the second direction between a first side frame 910 and a second side frame 920. Herein, the first direction may be an extension direction of the connection frame 930, and the second direction may be a direction intersecting the first direction.

According to this structure, the at least one support frame 940 may be provided further forward than the connection frame 930 to connect the first side frame 910 and the second side frame 920.

Like the hook member 160 according to one example, the hook member 960 may be rotatably coupled with respect to the connection frame 930 so as to be movable between the locked position and the accommodated position. The hook member 960 may include a rotational coupling part 961 coupled to the connection frame 930 and a hook protrusion 962 protruding from the rotational coupling part 961.

When the hook member 960 is disposed in the locked position, the first side frame 910 or the second side frame 920 may be disposed to face forward.

The foregoing has illustrated and described specific embodiments. However, it should be understood by those of skilled in the art that the present disclosure is not limited to the above-described embodiments, and various changes and modifications may be made without departing from the technical idea of the present disclosure described in the following claims.

What is claimed is:

1. A clothes care apparatus comprising:

a main body including a care room to accommodate clothes;

a support bar disposed on an upper side of the care room and extending between opposite side walls of the care room, a support disposed on a side wall of the opposite side walls of the care room;

a lock disposed on the side wall of the opposite side walls of the care room, and a shelf frame that is detachably supportable on the support, and includes:

a first side frame, a second side frame, a plurality of support frames between the first side frame and the second side frame, and a hook coupled to one of the first side frame and the second side frame, wherein the shelf frame is configured so that, when the shelf frame is supported on the support, the hook couples to the lock and is movable between a locked position in which the hook is coupled to the lock and protrudes to an outside of the shelf frame so as to be coupled to the support bar, so that the first side frame and the second side frame are supported on the support with the plurality of support frames supported by the support bar within the care room, and the plurality of support frames are spaced apart from each other in an up-down direction, and an accommodated position in which the hook is coupled to the lock and protrudes to an inside of the shelf frame so as not to be coupled to the support bar.

2. The clothes care apparatus according to claim 1, wherein the hook is on the first side frame to be and is rotatable with respect to the first side frame.

3. The clothes care apparatus according to claim 1, wherein the shelf frame further includes a hook accommodating groove to accommodate the hook.

4. The clothes care apparatus according to claim 3, wherein the first side frame includes a wire body and a hook housing connected to the wire body, and the hook and the hook accommodating groove are in the hook housing.

5. The clothes care apparatus according to claim 1, wherein the lock is rotatably coupled to the support.

6. The clothes care apparatus according to claim 1, wherein the hook is on the first side frame, and the second side frame includes a clamp to secure a position of clothes supported by the shelf frame.

7. The clothes care apparatus according to claim 6, wherein the clamp includes:

a cover rotatable with respect to the second side frame; and a coupling plate on the second side frame to fix the clothes to the second side frame.

8. The clothes care apparatus according to claim 1, wherein the shelf frame further includes an open portion adjacent to front ends of the plurality of support frames.

9. The clothes care apparatus according to claim 8, wherein the shelf frame further comprises includes an opening and closing frame to open or close the open portion.

10. The clothes care apparatus according to claim 9, wherein the opening and closing frame is movable between an opened position in which the opening and closing frame is coupled to the first side frame and the second side frame to open the open portion and a closed position in which the opening and closing frame closes the open portion.

11. The clothes care apparatus according to claim 8, wherein the shelf frame includes a first connection frame on a front side of the plurality of support frames and a second connection frame on a rear side of the plurality of support frames, the second connection frame is rotatable relative to the first side frame and the second side frame, and one side of each of the plurality of support frames is connected to the second connection frame and another side of each of the plurality of support frames is detachably coupled to the first connection frame.

* * * * *